US007455125B2

(12) United States Patent
Sinor et al.

(10) Patent No.: US 7,455,125 B2
(45) Date of Patent: Nov. 25, 2008

(54) DRILLING TOOL EQUIPPED WITH IMPROVED CUTTING ELEMENT LAYOUT TO REDUCE CUTTER DAMAGE THROUGH FORMATION CHANGES, METHODS OF DESIGN AND OPERATION THEREOF

(75) Inventors: L. Allen Sinor, Kingwood, TX (US); Jack T. Oldham, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 342 days.

(21) Appl. No.: 11/064,108

(22) Filed: Feb. 22, 2005

(65) Prior Publication Data

US 2006/0185901 A1 Aug. 24, 2006

(51) Int. Cl.
*E21B 10/36* (2006.01)
*E21B 47/00* (2006.01)

(52) U.S. Cl. ..... 175/40; 175/57

(58) Field of Classification Search ..... 175/431, 175/40, 57

See application file for complete search history.

(56) References Cited

U.S. PATENT DOCUMENTS

| | | | |
|---|---|---|---|
| 4,106,578 | A | 8/1978 | Beyer |
| 4,266,621 | A | 5/1981 | Brock |
| 4,323,130 | A | 4/1982 | Dennis |
| 4,429,755 | A | 2/1984 | Williamson |
| RE32,036 | E | 11/1985 | Dennis |
| 4,815,342 | A | 3/1989 | Brett et al. |
| 4,848,489 | A | 7/1989 | Deane |
| 4,872,520 | A | 10/1989 | Nelson |
| 4,932,484 | A | 6/1990 | Warren et al. |
| 5,010,789 | A | 4/1991 | Brett et al. |
| 5,042,596 | A | 8/1991 | Brett et al. |
| 5,111,892 | A | 5/1992 | Sinor et al. |
| 5,131,478 | A | 7/1992 | Brett et al. |
| 5,314,033 | A | 4/1994 | Tibbitts |
| 5,402,856 | A | 4/1995 | Warren et al. |

(Continued)

FOREIGN PATENT DOCUMENTS

| | | |
|---|---|---|
| WO | WO 90/12191 | 10/1990 |

OTHER PUBLICATIONS

PCT International Search Report mailed Jun. 1, 2006.

*Primary Examiner*—Jennifer H Gay
*Assistant Examiner*—Daniel Stephenson
(74) *Attorney, Agent, or Firm*—TraskBritt

(57) ABSTRACT

A drilling tool including at least two cutting elements (e.g., redundant or upon a selected profile region) sized, positioned, and configured thereon so as to contact or encounter a change in at least one drilling characteristic of a subterranean formation along an anticipated drilling path prior to other cutting elements thereon encountering same is disclosed. Methods of designing a drilling tool are also disclosed including placing such cutting elements upon the cutting element profile in relation to a predicted boundary surface along an anticipated drilling path. Methods of operating a drilling tool so as to initially contact a boundary surface between two differing regions of a subterranean formation drilled with at least two cutting elements is disclosed. The cutting elements configured on drilling tools and methods of the present invention may be designed for limiting lateral force or generating a lateral force having a desired direction during drilling associated therewith.

59 Claims, 21 Drawing Sheets

U.S. PATENT DOCUMENTS

| | | | | |
|---|---|---|---|---|
| 5,549,171 | A | | 8/1996 | Mensa-Wilmot et al. |
| 5,605,198 | A | | 2/1997 | Tibbitts et al. |
| 5,607,024 | A | | 3/1997 | Keith et al. |
| 5,607,025 | A | * | 3/1997 | Mensa-Wilmot et al. .... 175/431 |
| 5,706,906 | A | | 1/1998 | Jurewicz et al. |
| 5,720,357 | A | | 2/1998 | Fuller et al. |
| 5,787,022 | A | | 7/1998 | Tibbitts et al. |
| 5,873,422 | A | | 2/1999 | Hansen et al. |
| 5,881,830 | A | | 3/1999 | Cooley |
| 5,950,747 | A | | 9/1999 | Tibbitts et al. |
| 5,957,223 | A | | 9/1999 | Doster et al. |
| 5,957,225 | A | | 9/1999 | Sinor |
| 5,979,571 | A | | 11/1999 | Scott et al. |
| 6,021,858 | A | | 2/2000 | Southland |
| 6,021,859 | A | | 2/2000 | Tibbitts et al. |
| 6,142,250 | A | | 11/2000 | Griffin et al. |
| 6,164,394 | A | | 12/2000 | Mensa-Wilmot et al. |
| 6,230,828 | B1 | | 5/2001 | Beuershausen et al. |
| 6,298,930 | B1 | | 10/2001 | Sinor et al. |
| 6,302,223 | B1 | | 10/2001 | Sinor |
| 6,397,958 | B1 | | 6/2002 | Charles et al. |
| 6,460,631 | B2 | | 10/2002 | Dykstra et al. |
| 6,564,886 | B1 | | 5/2003 | Mensa-Wilmot et al. |
| 6,688,410 | B1 | | 2/2004 | Singh et al. |
| 7,000,715 | B2 | | 2/2006 | Sinor et al. |
| 7,178,609 | B2 | | 2/2007 | Hart et al. |
| 2002/0157869 | A1 | | 10/2002 | Glass et al. |
| 2005/0183892 | A1 | | 8/2005 | Oldham et al. |

* cited by examiner

DRILLING TOOL EQUIPPED WITH IMPROVED CUTTING ELEMENT LAYOUT TO REDUCE CUTTER DAMAGE THROUGH FORMATION CHANGES, METHODS OF DESIGN AND OPERATION THEREOF

BACKGROUND OF THE INVENTION

1. Field of the Invention

This invention relates generally to placement of cutting elements on a rotary drilling tool for use in drilling subterranean formations or other hard materials disposed within a subterranean formation, such as drill strings, casing components, and the like. More particularly, the invention pertains to placement of two or more redundant cutting elements upon a drilling tool so as to contact a change in formation characteristics between different subterranean regions between a formation and another structure disposed therein, or between two structures disposed in a borehole prior to contact by other cutting elements disposed thereon.

2. Background of Related Art

Conventionally, it is well-known that cutting elements located in the different positions on a face of a rotary drill bit may experience vastly different loading conditions, different wear characteristics, or both. The effects of the loading and wear have been accommodated in conventional rotary drill bits by variations in cutting element size, geometry, and configuration in relation thereto. However, conventional approaches to cutting element placement on a rotary drill bit often do not consider the effects and conditions of the cutting elements as well as the forces and torques associated therewith during an initial encounter of a transition during drilling between two adjacent subterranean formations having at least one differing characteristic. In addition, conventional approaches for cutting element placement on a rotary drill bit have not adequately addressed considerations of transitions occurring when drilling through downhole equipment, such as a casing shoe, the cement surrounding the casing shoe, and the formation therebelow.

Several approaches have been developed to accommodate varying loading conditions that may occur in different positions on a rotary drill bit face. For instance, U.S. Pat. Nos. 6,021,859, 5,950,747, 5,787,022, and 5,605,198 to Tibbitts, and Tibbitts et al., respectively, each of which is assigned to the assignee of the present invention, disclose selective placement of cutting elements of differing diamond table-to-substrate interface design at different locations on the bit face, to address different predicted or expected loading conditions.

In a conventional approach to improving the drilling performance of rotary drill bits, U.S. Pat. Nos. 6,164,394 and 6,564,886 to Mensa-Wilmot et al. each disclose rotary drill bits including cutting elements disposed at substantially identical radial positions wherein the rotationally preceding cutting element is oriented at a positive backrake angle, while the rotationally following cutting element is oriented at a negative backrake angle and exhibits less exposure than the rotationally preceding cutting element.

Similarly, U.S. Pat. No. 5,549,171 to Mensa-Wilmot et al. discloses a rotary drill bit, including sets of cutting elements mounted thereon, wherein each set of cutting elements includes at least two cutting elements mounted on different blades at generally the same radial position but having differing degrees of backrake and exposure.

Further, U.S. Pat. No. 4,429,755 to Williamson discloses a rotary drill bit including successive sets of cutting elements, the cutting elements of each set being disposed at equal radius from and displaced about the axis of rotation of the rotary drill bit through equal arcs, so that each cutting element of a set thereof is intended to trace a path which overlaps with the paths of adjacent cutting elements of other set or sets of cutting elements.

Also, U.S. Patent Application 2002/0157869 A1 to Glass et al. discloses a fixed-cutter drill bit, which is purportedly optimized so that cutter torques are evenly distributed during drilling of homogeneous rock and also in transitional formations. Methods utilizing predictive mathematical drilling force models are also disclosed.

Rotary drill bits, and more specifically fixed cutter or "drag" bits, have also been conventionally designed as so-called "anti-whirl" bits. Such bits use an intentionally unbalanced and oriented lateral or radial force vector, usually generated by the bit's cutters, to cause one side of the bit configured as an enlarged, cutter-devoid bearing area comprising one or more gage pads to ride continuously against the side wall of the well bore to prevent the inception of bit "whirl," a well-recognized phenomenon wherein the bit precesses around the well bore and against the side wall in a direction counter to the direction in which the bit is being rotated. Whirl may result in a borehole of enlarged (over gauge) dimension and out-of-round shape and in damage to the cutters and bit itself.

U.S. Pat. Nos. 5,010,789 and 5,042,596 to Brett et al., the disclosures of each of which are incorporated in their entirety by reference thereto, disclose anti-whirl drill bits. Further, U.S. Pat. No. 5,873,422 to Hansen et al., assigned to the assignee of the present invention and the disclosure of which is incorporated in its entirety by reference thereto, discloses support structures in a normally cutter devoid zone to stabilize the drill bit.

In a further approach to stabilize rotary drill bits while drilling, selective placement of cutting elements upon a rotary drill bit may create stabilizing grooves, kerfs, or ridges. Such configurations are intended to mechanically inhibit lateral vibration, assuming sufficient vertical or weight-on-bit force is applied to the rotary drill bit.

For instance, U.S. Pat. No. 4,932,484 to Warren et al. discloses forming a groove by placing a cutting element offset from the other cutting elements positioned along a cutting element profile. Also, U.S. Pat. No. 5,607,024 to Keith et al. discloses cutting elements having differing regions of abrasion resistance. Such a configuration is purported to laterally stabilize the rotary drill bit within the borehole because as the cutting elements wear away, radially alternating grooves and ridges may be formed.

However, despite the aforementioned conventional approaches to improving drilling performance of a rotary drill bit or other drilling tool by configuring the placement or design of the cutting elements thereon, there remains a need for improved apparatus and methods for drilling with a rotary drill bit between differing materials or formation regions with different properties.

SUMMARY OF THE INVENTION

The present invention provides a drilling tool, such as a rotary drill bit, including at least two substantially redundant cutting elements that are positioned thereon to encounter a change in at least one physical characteristic of adjacent materials being drilled through. More specifically, examples of adjacent materials being drilled through may include a casing component, hardened cement, and a subterranean formation, two adjacent subterranean formations, or two regions of a subterranean formation having at least one differing characteristic. The at least two redundant cutting elements may be sized, positioned, and configured upon a drilling tool so as to contact or encounter a change in at least one material characteristic prior to other cutting elements encountering same. Put another way, the at least two redundant cutting elements may be positioned at an anticipated location of first contact of the drilling tool with a predicted boundary surface. Such a configuration may inhibit damage that may occur if a single cutting element were to encounter the change in the material being drilled. Thus, as used herein, the term "redundant" means that the at least two cutting elements traverse substantially the same helical drilling path.

The present invention also comprises methods of designing a drilling tool, such as a rotary drill bit. Specifically, a cutting element profile, a subterranean formation to be drilled, and an anticipated path for drilling through the subterranean formation may be selected. Further, at least one boundary surface between two regions of the structure to be drilled may be predicted. A plurality of cutting elements may be placed upon the profile including placing at least two redundant cutting elements of the plurality of cutting elements that are placed upon the cutting element profile at an anticipated location of first contact of the drilling tool with the predicted boundary surface.

The present invention further encompasses a method of operating a drilling tool, such as a rotary drill bit. Accordingly, a drilling tool including a plurality of cutting elements may be provided, wherein at least two of the cutting elements are redundant. A boundary surface may be predicted, wherein the boundary surface is defined between two abutting regions of a subterranean formation, the two abutting regions having at least one different drilling characteristic. Further, a drilling path may be determined, wherein the drilling path is oriented for positioning the redundant cutting elements at an anticipated location of first contact of the drilling tool with a predicted boundary surface upon drilling generally therealong. Also, drilling may occur into the predicted boundary surface generally along the orientation of the anticipated drilling path.

In another aspect of the present invention, it is recognized that encountering a change in at least one physical characteristic of adjacent materials being drilled through by redundant cutting elements may change the magnitude of lateral imbalance or torque on the drilling tool, which may adversely affect the stability thereof. Therefore, the present invention contemplates that the magnitude of net lateral force or net torque of redundant cutting elements may be reduced or minimized during drilling between regions of the material being drilled having differing characteristics. In one embodiment, the redundant cutting elements may be sized and configured to generate individual lateral forces that substantially cancel in combination with one another. Alternatively, redundant cutting elements may be sized and configured to generate individual lateral forces that have relatively small magnitude in relation to the magnitude of net lateral force produced by the other cutting elements disposed upon a drilling tool. In yet a further embodiment, a net direction of the imbalance force of the plurality of cutting elements in the region may be within ±70° of a net imbalance direction of the drill bit (i.e., all the cutting elements) when drilling a homogeneous formation.

The present invention provides a drilling tool, such as a rotary drill bit, including a profile having a plurality of cutting elements disposed thereon, wherein at least a portion of the profile is structured for causing initial contact between the plurality of cutting elements positioned thereon and a predicted boundary surface of a subterranean formation.

Also, a method of designing a drilling tool encompassed by the present invention includes selecting a cutting element profile and selecting a subterranean formation to be drilled. Additionally, an anticipated drilling path for drilling through the subterranean formation may be selected and a boundary surface between two regions of the subterranean formation may be predicted, wherein the two regions exhibit at least one different drilling characteristic. A plurality of cutting elements may be placed within the region of the profile and the plurality of cutting elements within the region may be positioned at an anticipated location of first contact of the drilling tool with the predicted boundary surface.

In another aspect of the present invention, a method of operating a drilling tool is disclosed. Particularly, a drilling tool including a plurality of cutting elements within a region of a profile of the drilling tool may be provided. Also, a boundary surface defined between two abutting regions of a subterranean formation may be predicted, the two abutting regions having at least one different drilling characteristic. Further, a drilling path may be determined, the drilling path oriented for positioning the redundant cutting elements at an anticipated location of first contact of the drilling tool with a predicted boundary surface upon drilling generally therealong. Additionally, a plurality of cutting elements may be positioned within the region of the profile at an anticipated location of first contact of the drilling tool with the predicted boundary surface. Drilling into the predicted boundary surface generally along the orientation of the anticipated drilling path may be performed.

Therefore, the present invention contemplates that the magnitude of net lateral force of the plurality of cutting elements within the region may be reduced or minimized during drilling between regions of the material being drilled having differing characteristics. In one embodiment, the plurality of cutting elements within the region may be sized and configured to generate individual lateral forces that substantially cancel in combination with one another. Alternatively, the plurality of cutting elements within the region may be sized and configured to generate individual lateral forces that have relatively small magnitude in relation to the magnitude of net lateral force produced by the other cutting elements disposed upon a drilling tool. Further, a net direction of the imbalance force of the plurality of cutting elements (in the region) upon engagement with a boundary surface may be within ±70° of a net imbalance direction of the drill bit (i.e., all the cutting elements) when drilling a homogeneous formation.

Drilling tools such as rotary drill bits, casing bits, reamers, bi-center rotary drill bits, reamer wings, bi-center drill bits, or other drilling tools as known in the art utilizing cutting elements may benefit from the present invention and, as used herein, the term "rotary drill bit" encompasses any and all such apparatuses.

BRIEF DESCRIPTION OF THE SEVERAL VIEWS OF THE DRAWINGS

The foregoing and other advantages of the present invention will become apparent upon review of the following detailed description and drawings, which illustrate various embodiments of the invention, which are not necessarily drawn to scale, wherein:

FIG. 4A-2 is a partial side cross-sectional view of another exemplary rotary drill bit of the present invention, as if each of its cutting elements were rotated into a single blade;

FIG. 4A-3 is a partial side cross-sectional view of a further exemplary rotary drill bit of the present invention, as if each of its cutting elements were rotated into a single blade;

DETAILED DESCRIPTION OF THE INVENTION

The several illustrated embodiments of the invention depict various features which may be incorporated into a rotary drill bit in a variety of combinations. As explained in further detail below, the present invention relates to providing redundant cutting elements which are positioned upon a drilling tool to encounter, prior to the other cutting elements disposed upon the rotary drill bit, changes in structure that is desired to be drilled into or through, regions or different materials thereof. Such a configuration may reduce loading and damage that may occur when a single cutting element contacts a material or region of a structure prior to the other cutting elements contacting same.

Figure 1A:
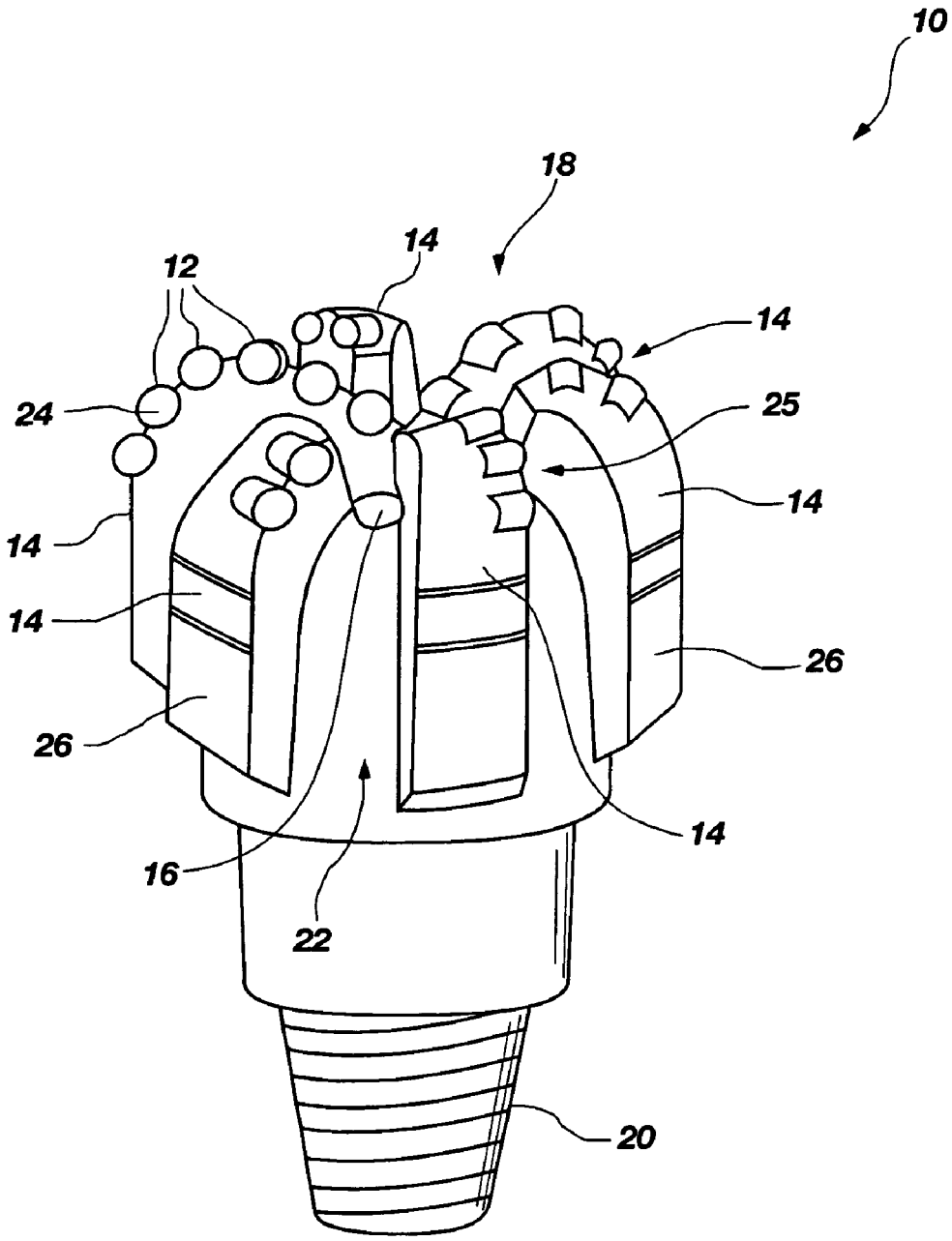
FIG. 1A is a side perspective view of an exemplary rotary drill bit of the present invention.

FIG. 1A shows a side perspective view of an exemplary rotary drill bit 10 of the present invention. Rotary drill bit 10 includes generally cylindrical cutting elements 12 affixed to radially and longitudinally extending blades 14, nozzle cavities 16 for communicating drilling fluid from the interior of the rotary drill bit 10 to the cutting elements 12, face 18, and threaded pin connection 20 for connecting the rotary drill bit 10 to a drilling string, as known in the art. Cutting elements 12 may comprise polycrystalline diamond compact (PDC) cutters, as known in the art. Alternatively, cutting elements 12 may comprise tungsten carbide cutting elements, which may be useful in drilling through casing equipment or other structures. Cutting elements 12 may exhibit a substantially planar cutting surface 24, as shown in FIG. 1A. Also, blades 14 may define fluid courses 25 between circumferentially adjacent blades 14, extending to junk slots 22, formed between circumferentially adjacent gage pads 26.

Figure 1B:
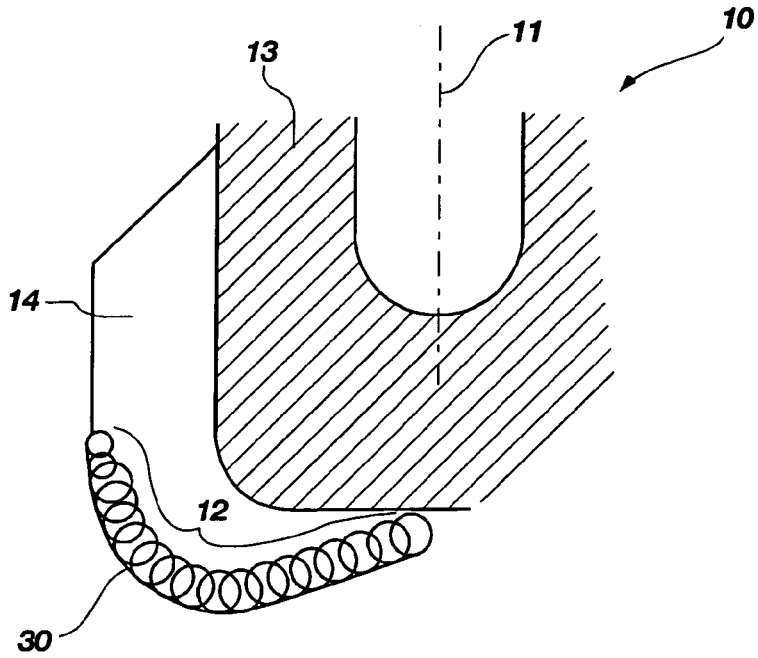
FIG. 1B is a partial side cross-sectional view of the rotary drill bit shown in FIG. 1A as if each of its cutting elements were rotated into a single blade.

FIG. 1B shows a schematic partial side cross-sectional view of rotary drill bit 10, as if each of cutting elements 12 disposed thereon were rotated onto a single blade 14 protruding from bit body 13. Such a view is commonly termed a "cutter layout" drawing or "cutting element layout" drawing and may be used to design rotary drill bits, as known in the art. More particularly, each of cutting elements 12 are shown in relation to longitudinal axis 11, the distance from which corresponds to their radial position on the rotary drill bit 10. Cutting elements 12 may be positioned along a selected profile 30, as known in the art. As shown in FIG. 1B, radially adjacent cutting elements 12 may overlap with one another. Furthermore, according to the present invention, two or more cutting elements 12 of rotary drill bit 10 may be positioned at substantially the same radial and longitudinal position.

Figure 1C:
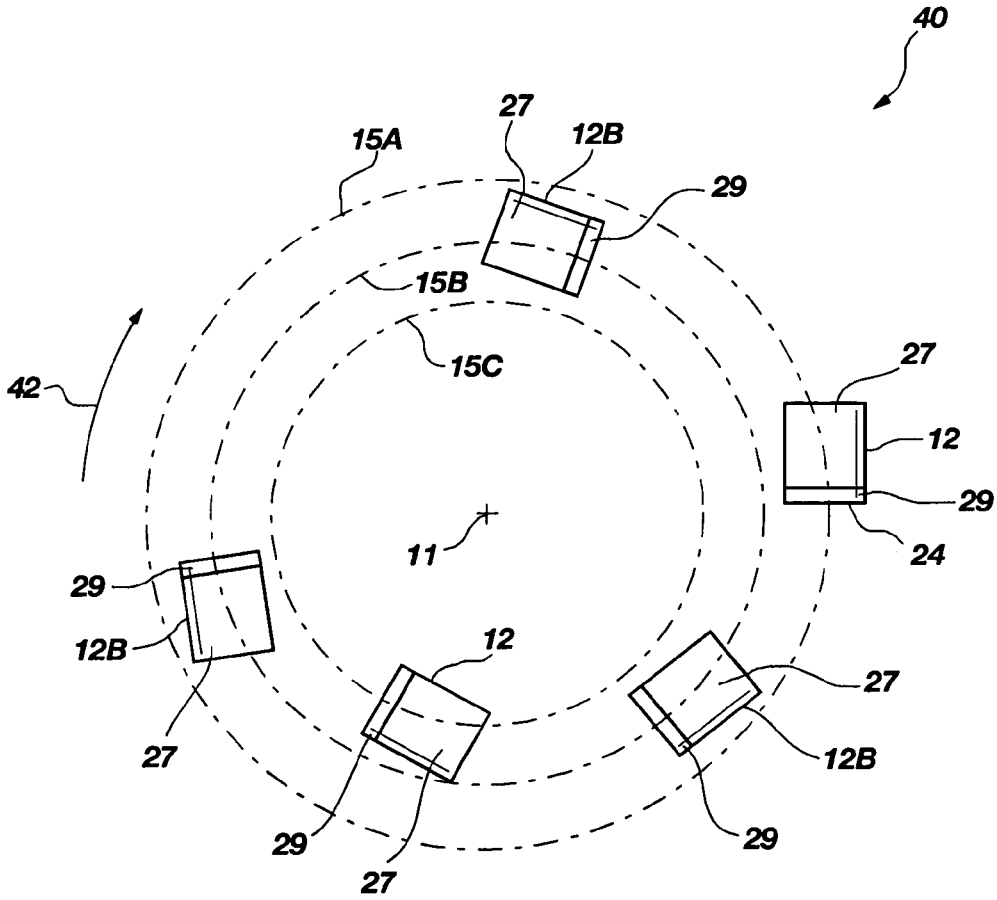
FIG. 1C is a partial schematic top elevation cutter layout view of the rotary drill bit shown in FIG. 1A.

Explaining further, FIG. 1C shows a top schematic view depicting a cutter layout view 40, as if viewing a rotary drill bit 10 from the bottom of a borehole (not shown) into which rotary drill bit 10 was drilling, of cutting elements 12 and redundant cutting elements 12B of rotary drill bit 10, which are disposed about reference circles 15A, 15B, and 15C, respectively. Each of cutting elements 12 and each of redundant cutting elements 12B may comprise a superabrasive table 29 affixed to a substrate 27. For example, each of cutting elements 12 and each of redundant cutting elements 12B may comprise PDC cutters, as known in the art. Of course, reference circles 15A, 15B, and 15C increase in diameter, with respect to longitudinal axis 11, with the radial position of cutting elements 12 and redundant cutting elements 12B disposed thereon, respectively, increasing accordingly. During drilling, assuming that the rotary drill bit 10 rotates about longitudinal axis 11 along direction 42, cutting elements 12 and redundant cutting elements 12B may move, translate, or traverse along reference circles 15A, 15B, and 15C, respectively.

As may be appreciated, the three (3) redundant cutting elements 12B are positioned at substantially the same radial and longitudinal position with respect to longitudinal axis 11. However, redundant cutting elements 12B are separated circumferentially and, therefore, may be disposed on different blades 14 of rotary drill bit 10. Redundant cutting elements 12B may be spaced circumferentially symmetrically about longitudinal axis 11, or, alternatively, circumferentially asymmetrically, as may be desired. Also, cutting elements 12 as well as redundant cutting elements 12B may exhibit siderake and backrake orientations, as known in the art.

Figure 1D:
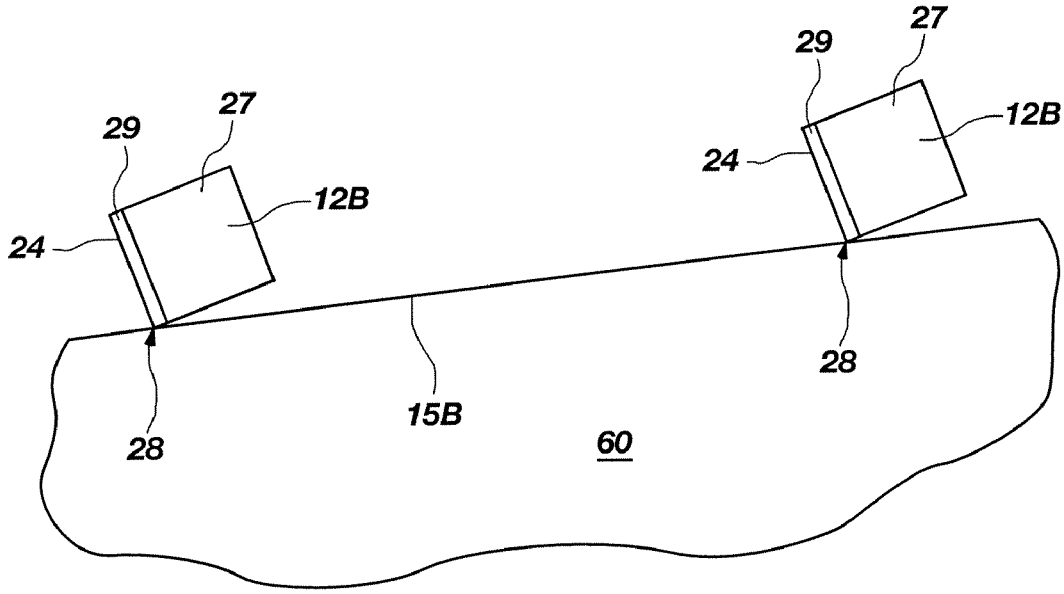
FIG. 1D is a side cross-sectional view of a helical cutting path followed by cutting elements depicted in FIG. 1C.

Redundant cutting elements 12B may traverse substantially the same drilling path. As known in the art, the path which cutting elements 12 and redundant cutting elements 12B traverse is helical in nature, as described in more detail in U.S. Pat. No. 5,314,033 to Tibbitts, assigned to the assignee of the present invention and the disclosure of which is incorporated in its entirety by reference thereto. More particularly, since a rotary drill bit 10, during drilling, is simultaneously rotating and moving downward into a formation as the borehole is cut, the cutting path followed by an individual cutter disposed thereon may follow a generally helical path, as conceptually shown with respect to FIG. 1D. The helical cutting path traveled by the redundant cutting elements 12B is illustrated by solid line 15B, which is also the reference circle 15B as shown in FIG. 1C, but unscrolled or unwound to show a side view thereof, and extends along the upper surface of formation 60. Thus, longitudinally lowermost edge 28 of redundant cutting elements 12B follows a downward helical path generally indicated by line 15B (the path, as explained above, being unscrolled on the page), but, of course, redundant cutting elements 12B may penetrate into the formation 60, the cutting surfaces 24 thereof shearing or cutting thereinto.

Of course, at a minimum, two redundant cutting elements 12B may be redundant in relation to one another. Alternatively, in the case of more than two redundant cutting elements 12B, each redundant cutting element 12B may be redundant in relation to each of the other redundant cutting elements 12B.

Figure 1E:
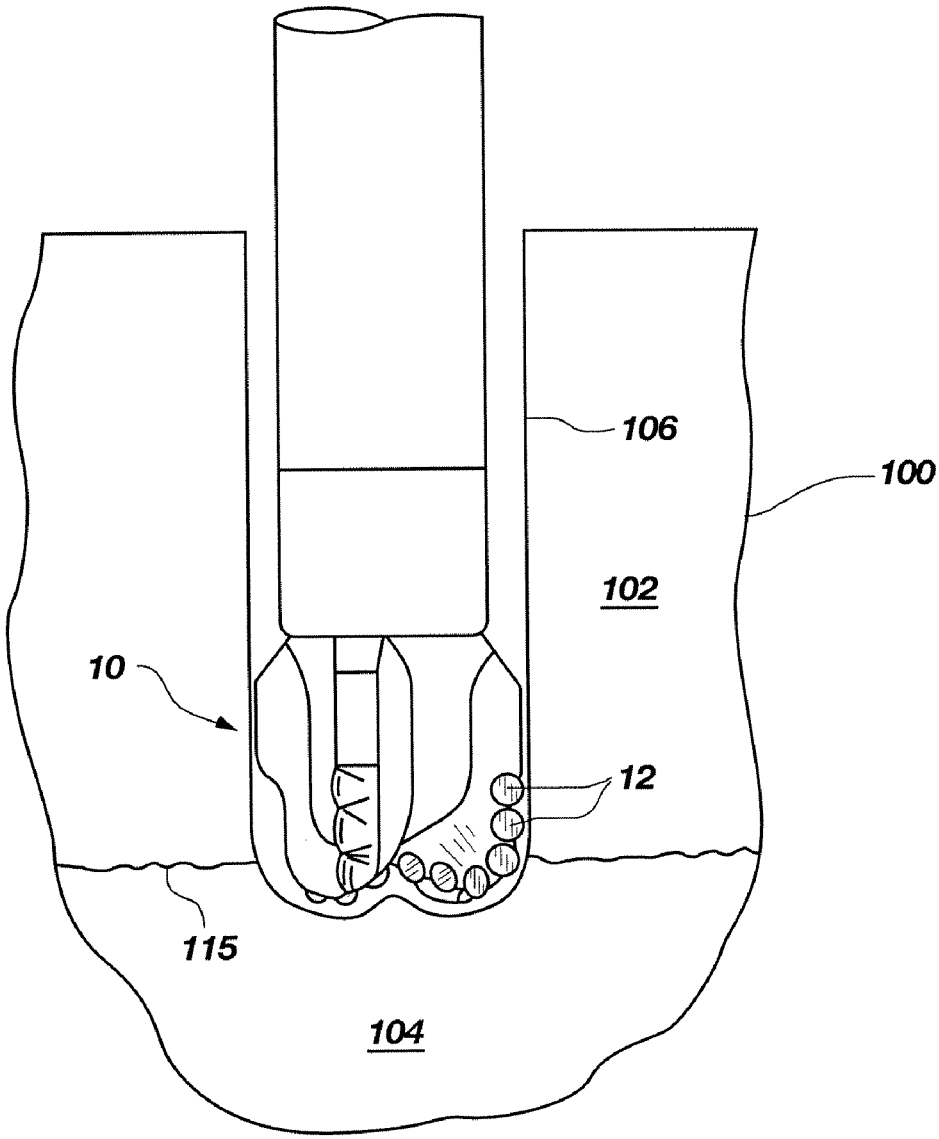
FIG. 1E is a schematic side view of the rotary drill bit shown in FIGS. 1A-1D of the present invention during drilling a borehole into a formation.

Therefore, it may be appreciated that cutting elements 12 and redundant cutting elements 12B of rotary drill bit 10 may encounter different regions, strata, or layers of a subterranean formation as a rotary drill bit 10 drills therethrough to form borehole 106, as depicted in FIG. 1E. More specifically, FIG. 1E shows schematic side view of rotary drill bit 10 having cutting elements 12 disposed thereon during drilling of formation 100. Formation 100 includes region 102 and region 104, which are adjacent to one another along boundary surface 115. Region 102 and region 104 may exhibit one or more different properties with respect to drilling thereof. Explaining further, region 102 and region 104 of subterranean formation 100 may comprise different subterranean constituents. For example, region 102 may comprise shale, while region 104 may comprise sandstone or vice-versa. Hence, the properties or drilling characteristics of region 102 and region 104 may exhibit differences in response to drilling thereof.

One particular situation that may cause damage to one or more cutting elements of a rotary drill bit may occur in drilling from a relatively soft formation region into a relatively hard formation region. "Soft" and "hard" may correlate generally to a lower and higher compressive strength, respectively, of a material, but may also relate, from lower to higher, respectively to the elasticity, abrasivity, or actual hardness of the material being drilled. Conventional rotary drill bits containing one cutting element that first encounters or contacts the harder region may be damaged by such contact. Explaining further, the conventional rotary drill bit may progress through the relatively soft formation rather rapidly, and relatively rapid isolated engagement of a cutting element with the relatively hard region may generate excessive forces thereon, which may damage the cutting element.

Consequently, the present invention contemplates that at least two redundant cutting elements 12B may be positioned on a rotary drill bit 10 within a region of anticipated initial engagement with respect to an expected, measured, or predicted change between two regions of a formation so as to mitigate or distribute the forces that are encountered by drilling therebetween. Turning back to FIG. 1C in conjunction with FIG. 1E, the position of redundant cutting elements 12B (i.e., the position of reference circle 15B) may be adjusted to substantially correspond with an expected position of initial engagement with a region 104 of a subterranean formation 100 in relation to a transition between differing regions 102 and 104 thereof. Put another way, two or more redundant cutting elements 12B may be positioned to initially engage a formation change, prior to the other cutting elements 12 disposed upon the rotary drill bit 10 engaging same, depending on the orientation of the drilling path with respect to the topography of the boundary surface 115 shape between the regions 102 and 104 of the formation.

There may be many different configurations in which redundant cutting elements may be employed to initially contact a change in a material being drilled. Generally, redundant cutting elements may be disposed upon a rotary drill bit in any position that corresponds to an expected initial contact point with a change in a drilling condition of a structure being drilled. Such a configuration may reduce damage to one or more cutting elements disposed on the rotary drill bit as compared to the damage that may be incurred by a single cutting element by distributing forces, by distributing damage, or both, between redundant cutting elements.

It should be recognized that positions of cutting elements for initial engagement with a formation may vary due to manufacturing limitations or for other reasons. Accordingly, the actual position of redundant cutting elements may be within about ±0.020 inch of a desired placement thereof. Thus, redundant cutting element may be placed at substantially a desired position of initial engagement with a formation according to the present invention.

Figure 2A:
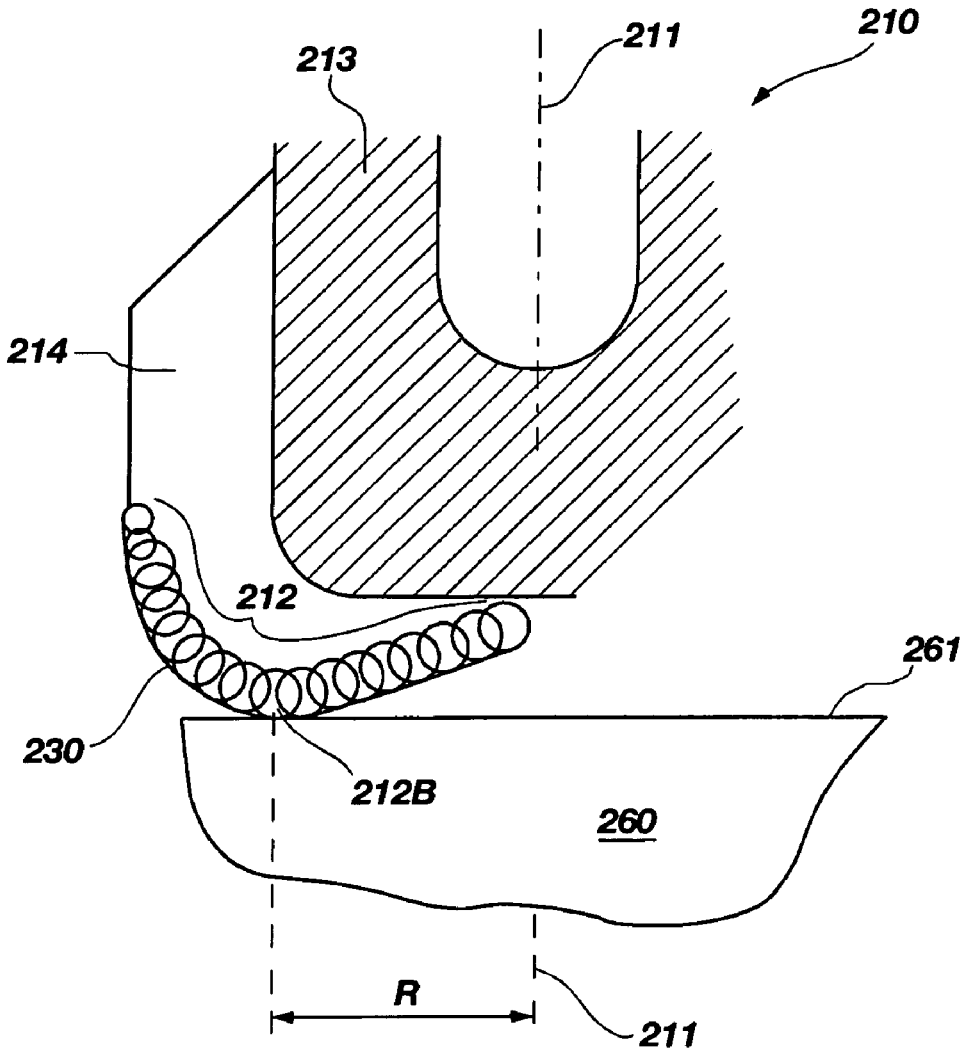
FIG. 2A is a partial side cross-sectional view of an exemplary rotary drill bit of the present invention, as if each of its cutting elements were rotated into a single blade.

In one embodiment of a rotary drill bit of the present invention as depicted in FIG. 2A, redundant cutting elements 212B may be positioned in accord with the longitudinally lowermost cutting element position or cutting element corresponding to the nadir of the cutting element layout or profile. FIG. 2A shows a side cross-sectional view of rotary drill bit 210 as if each of cutting elements 212 were rotated into a single blade 214 extending from bit body 213, in relation to longitudinal axis 211 and along profile 230. FIG. 2A also shows formation 260 having upper surface 261, which is substantially perpendicular to longitudinal axis 211. Redundant cutting elements 212B may be positioned at the longitudinally lowermost cutting element position of any of cutting elements 212, the radial position of which, in relation to longitudinal axis 211, is labeled "R." Therefore, as may be appreciated, redundant cutting elements 212B may engage formation 260 having upper surface 261 that is substantially perpendicular to longitudinal axis 211 substantially concurrently and prior to any other cutting elements 212 engaging same.

Initial engagement between distinct regions of a structure while drilling may occur with redundant cutting elements substantially concurrently in relation to one another if the rotary drill bit on which the redundant cutting elements are placed drills into a boundary surface that is substantially symmetric about the drilling axis (i.e., the longitudinal axis). The drilling surface (not shown) of rotary drill bit 210 will be shaped in the form of profile 230, rotated about the longitudinal axis 211.

Since the drilling surface of rotary drill bit 210 may be substantially symmetric about the longitudinal axis 211, engagement of a boundary surface (i.e., upper surface 261 of formation 260) that is substantially symmetric about the longitudinal axis 211 may cause the initial engagement between redundant cutting elements 212B and the boundary surface (i.e., upper surface 261 of formation 260) to occur substantially concurrently with respect to one another. Alternatively, initial engagement with a boundary surface (not shown), which is not substantially symmetrical about the drilling axis or longitudinal axis 211 of rotary drill bit 210 may be engaged sequentially by redundant cutting elements 212B, which may beneficially reduce or distribute damage thereamong.

Figure 2B:
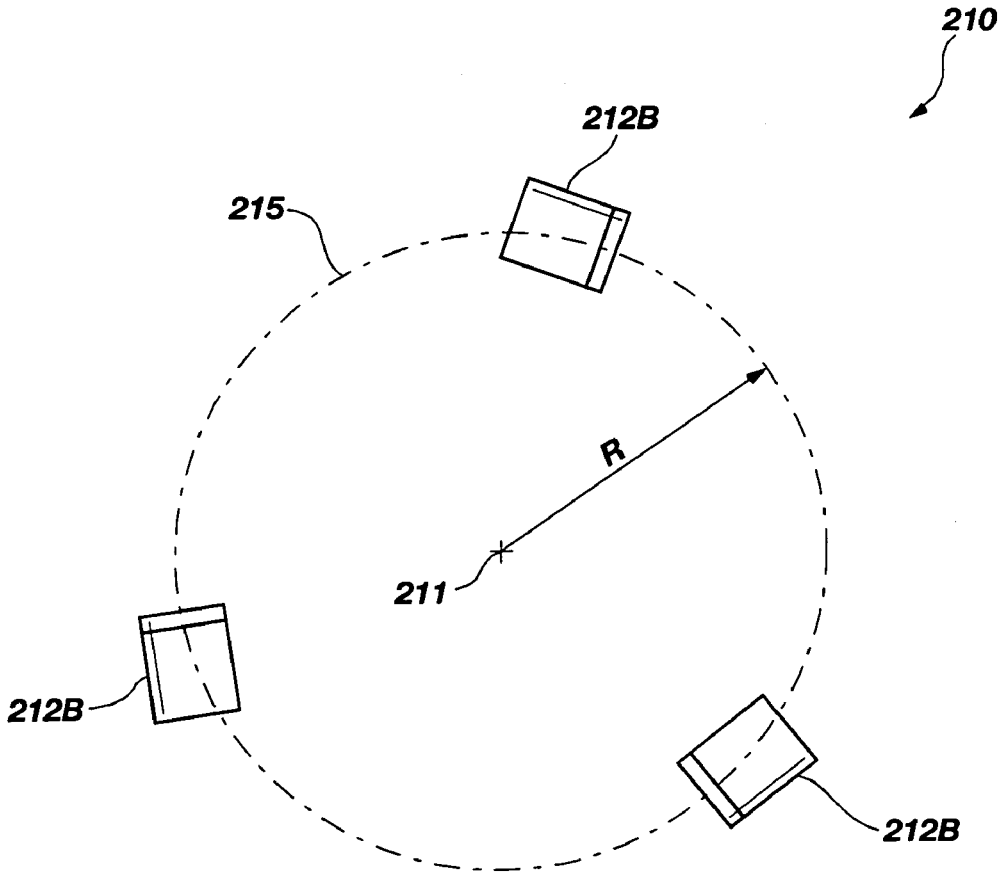
FIG. 2B is a partial schematic top elevation cutter layout view of the rotary drill bit shown in FIG. 2A.
Figure 2C:
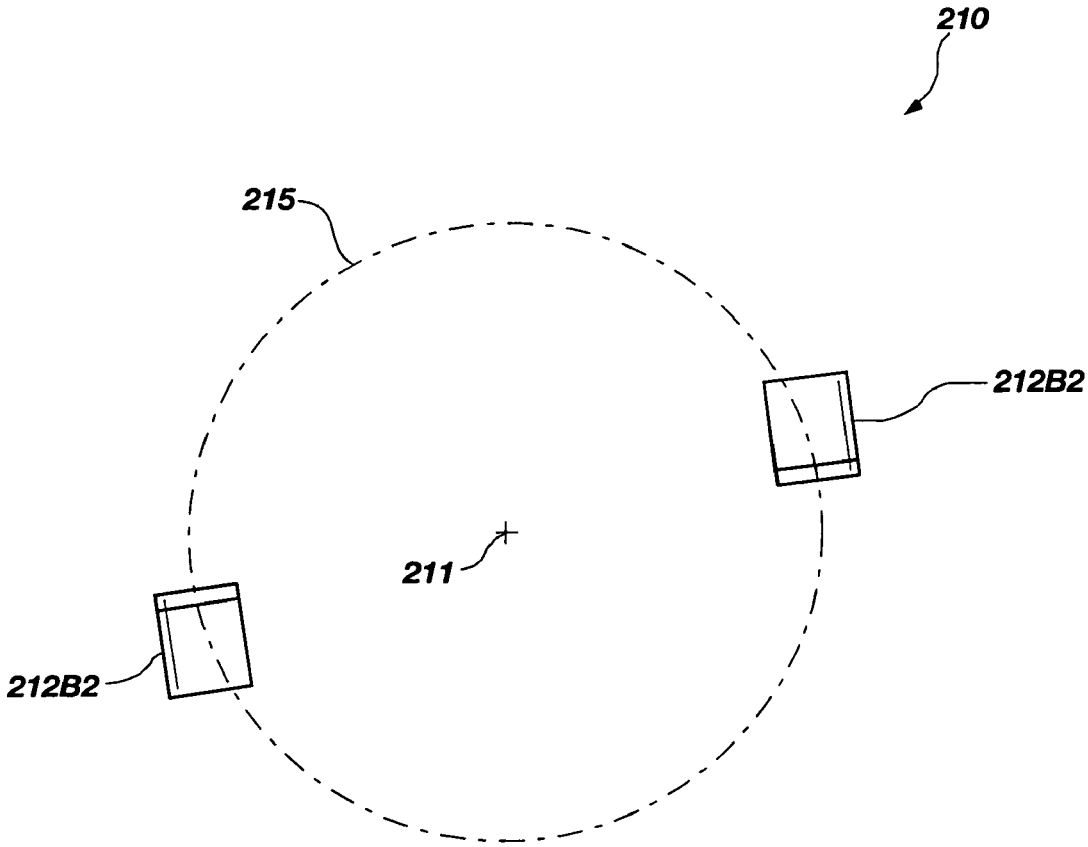
FIG. 2C is a partial schematic top elevation cutter layout view of the present invention including two redundant cutting elements.

Thus, according to the present invention, rotary drill bit 210 may include two or more redundant cutting elements 212B. As shown in FIG. 2B, which shows a partial schematic top elevation cutter layout view of the rotary drill bit shown in FIG. 2A, three redundant cutting elements 212B may be positioned to rotate, during drilling, about longitudinal axis 211, along reference circle 215, which has a radius substantially equal to R. Of course, as shown in FIG. 2C, alternatively, two redundant cutting elements 212B2 may be positioned to rotate, during drilling, about longitudinal axis 211 along reference circle 215. In a further alternative, more than three redundant cutting elements (not illustrated) may be configured to rotate, during drilling, about longitudinal axis 211 along reference circle 215, without limitation. Thus, the present invention contemplates that a drilling tool, such as rotary drill bit 210, of the present invention may include at least two redundant cutting elements disposed thereon.

Such redundancy in redundant cutting elements 212B, which are positioned at the longitudinally lowermost cutting element position, may provide beneficial transition into a change in formation that is initially engaged by same. Put another way, more than one cutting element substantially radially and longitudinally identically positioned to initially engage a change in formation may beneficially distribute forces associated with drilling into such a change in formation by inhibiting damage to the cutting elements so positioned.

Figure 3A:
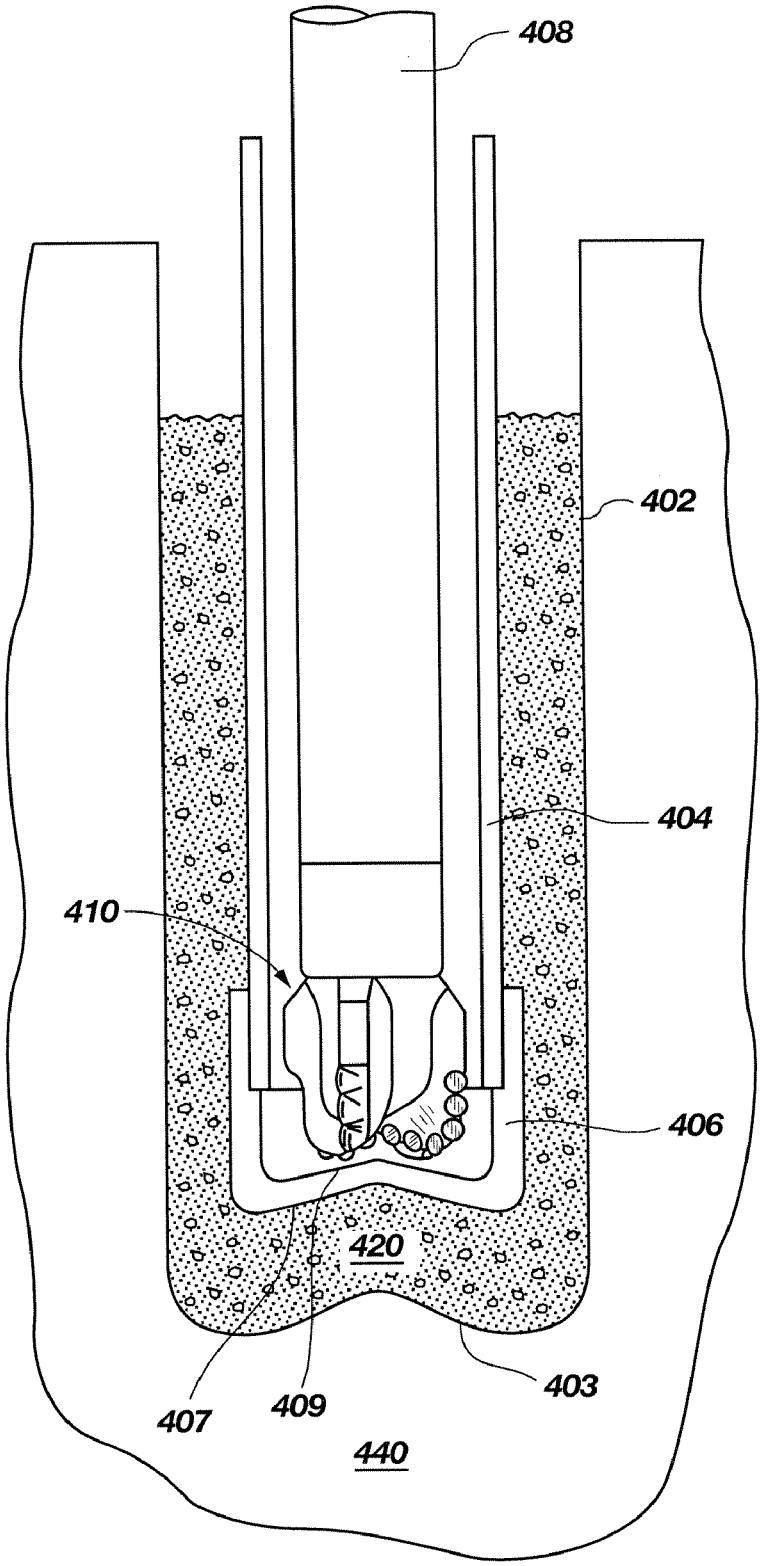
FIG. 3A is a side schematic partial cross-sectional view of an exemplary rotary drill bit of the present invention disposed within a cemented casing shoe assembly.

In another facet of the present invention, a rotary drill bit of the present invention may be beneficially configured and used to drill through downhole casing assemblies or portions thereof, such as casing, casing shoes, and cement disposed thereabout. FIG. 3A shows, in a side schematic partial cross-sectional view, casing section 404, affixed to casing shoe 406 may be disposed within borehole 402, which is typically formed by operation of a rotary drill bit (not shown) to drill into formation 440. Casing section 404 and casing shoe 406 may be cemented within borehole 402 to stabilize the formation thereabout and for additional reasons, as known in the art. Subsequently, it is often desired to drill through the casing shoe 406, cement 420 therebelow, and continue drilling into the formation 440. Thus, rotary drill bit 410 of the present invention may be disposed within casing section 404 for drilling through the casing shoe 406, cement 420 therebelow, and into the formation 440.

As may be recognized, rotary drill bit 410, as shown in FIG. 3A, must drill through transitions or boundary surfaces between the casing shoe 406, cement 420, and formation 440 prior to drilling a full size borehole within formation 440. First, rotary drill bit 410 disposed at the end of drill string 408 encounters and drills the inner profile 409 of casing shoe 406, which may typically comprise aluminum or other relatively malleable metal or alloy. Then, rotary drill bit 410 encounters the upper boundary surface of cement 420, which may substantially conform to the outer profile 407 of casing shoe 406. Cement 420 may comprise a hardened material, for instance concrete, including a binding substance such as cement and an aggregate, such as sand or gravel, as known in the art. Further, rotary drill bit 410 may engage formation 440 along boundary surface 403, the topography of which may be determined by the drilling tool (not shown) which was used to form borehole 402. It may also be apparent that the geometry of the above-described transitions or boundary surfaces may be known or to some extent, predictable, by selection of the drilling tool (not shown) employed to form borehole 402, the casing shoe 406, or both. Further, casing shoe 406, cement 420, and formation 440 may be characterized as different regions that exhibit one or more distinct drilling characteristics. Since the constituents and mechanical properties of each of casing shoe 406, cement 420, and formation 440 may be different or distinct, drilling within each may exhibit unique forces or behavior.

Figure 3B:
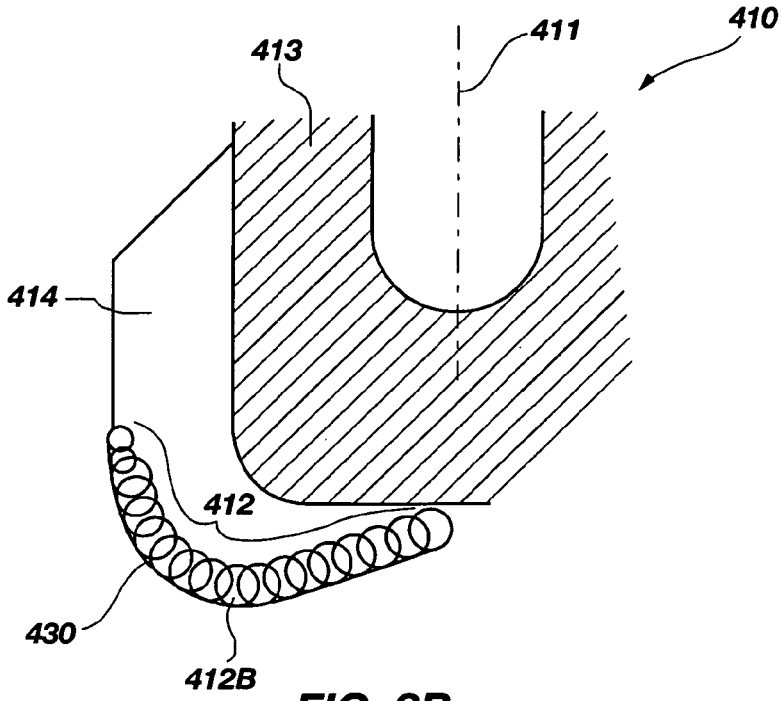
FIG. 3B is a partial schematic side cross-sectional view of the rotary drill bit shown in FIG. 3A, as if each of cutting elements were rotated into a single blade.

Therefore, as shown in FIG. 3B, rotary drill bit 410 may include redundant cutting elements 412B. FIG. 3B shows a partial schematic side cross-sectional view of rotary drill bit 410 as if each of cutting elements 412 were rotated into a single blade 414 extending from bit body 413, in relation to longitudinal axis 411 and along profile 430. Redundant cutting elements 412B may be positioned at the longitudinally lowermost cutting element position of any of cutting elements 412, as shown in FIG. 3B. Accordingly, redundant cutting elements 412B may engage the inner profile 409 of casing shoe 406, the upper surface of cement 420 defined by the outer profile 407 of casing shoe 406, and the boundary surface 403 of formation 440, all as shown in FIG. 3A, prior to any other cutting elements 412 engaging same. Such a configuration may inhibit damage that may occur if only one cutting element 412 were positioned at the longitudinally lowermost cutting element position upon rotary drill bit 410.

Alternatively, it may be noted that the cutting element position of initial engagement of the rotary drill bit 410 in relation to each of the transitions between casing shoe 406, cement 420, and formation 440 may be positioned differently. Put another way, different cutting element positions may initially contact the transitions between casing shoe 406 and cement 420, and between the cement 420 and the formation 440, depending on the shape thereof, respectively in relation to the profile 430 shape. Therefore, the present invention contemplates that rotary drill bit 410 may include more than one group or set of redundant cutting elements at different radial positions thereon.

Figure 3C:
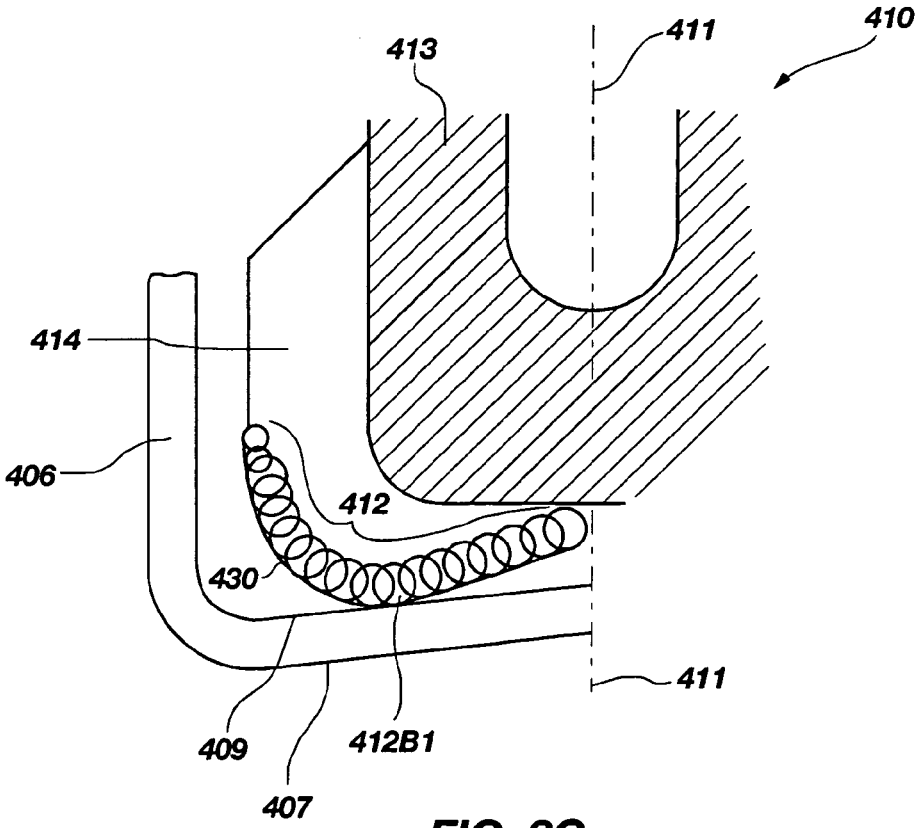
FIG. 3C is another partial schematic side cross-sectional view of the rotary drill bit shown in FIG. 3A, as if each of cutting elements were rotated into a single blade.

Illustratively, FIG. 3C shows a partial schematic side cross-sectional view of rotary drill bit 410 as if each of cutting elements 412 were rotated into a single blade 414 along profile 430. FIG. 3C also shows casing shoe 406 having inner profile 409 in relation to longitudinal axis 411. Clearly, it may be seen that the redundant cutting elements 412B1 may be beneficial with respect to drilling into the inner profile 409 of casing shoe 406, since the cutting element position of redundant cutting elements 412B1 may initially contact, prior to other cutting elements 412, the inner profile 409 of casing shoe 406 upon drilling thereinto. Of course, outer profile 407 of casing shoe 406 may be shaped substantially congruently with respect to inner profile 409, which may cause the upper surface of cement 420 to be initially contacted by redundant cutting elements 412B1. Alternatively, outer profile 407 may be shaped differently than inner profile 409. In such a configuration, additional redundant cutting elements (not shown) may be provided upon rotary drill bit 410 to initially contact the boundary surface between outer profile 407 and cement 420.

Figure 3D:
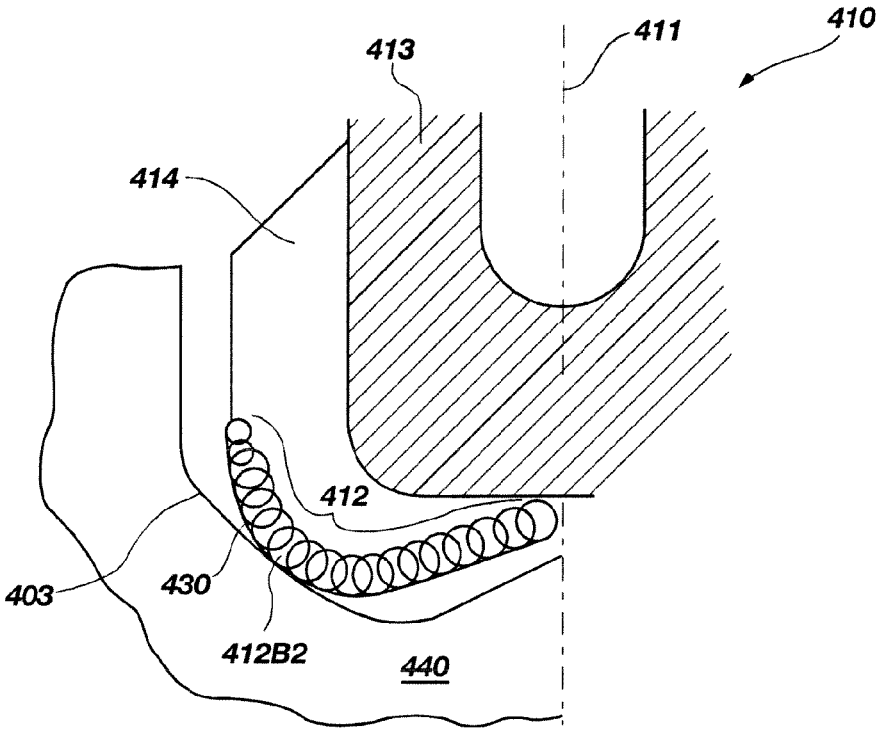
FIG. 3D is a further partial schematic side cross-sectional view of the rotary drill bit shown in FIG. 3A, as if each of cutting elements were rotated into a single blade.

Likewise, the prior drilling tool that formed the boundary surface 403 of formation 440 may have a unique shape that may not be contacted initially by redundant cutting elements 412B1. FIG. 3D shows a partial schematic side cross-sectional view of rotary drill bit 410 as if each of cutting elements 412 were rotated into a single blade 414 along profile 430, in relation to longitudinal axis 411. FIG. 3D further shows boundary surface 403 of formation 440 in relation to longitudinal axis 411. Since redundant cutting elements 412B1 may not initially contact boundary surface 403 of formation 440, it may be appreciated that the redundant cutting elements 412B2 may be beneficial with respect to drilling into the boundary surface 403 of formation 440, since the cutting element position of redundant cutting elements 412B2 may initially contact, prior to other cutting elements 412 or 412B1, the boundary surface 403 of formation 440 upon drilling thereinto.

Figure 3E:
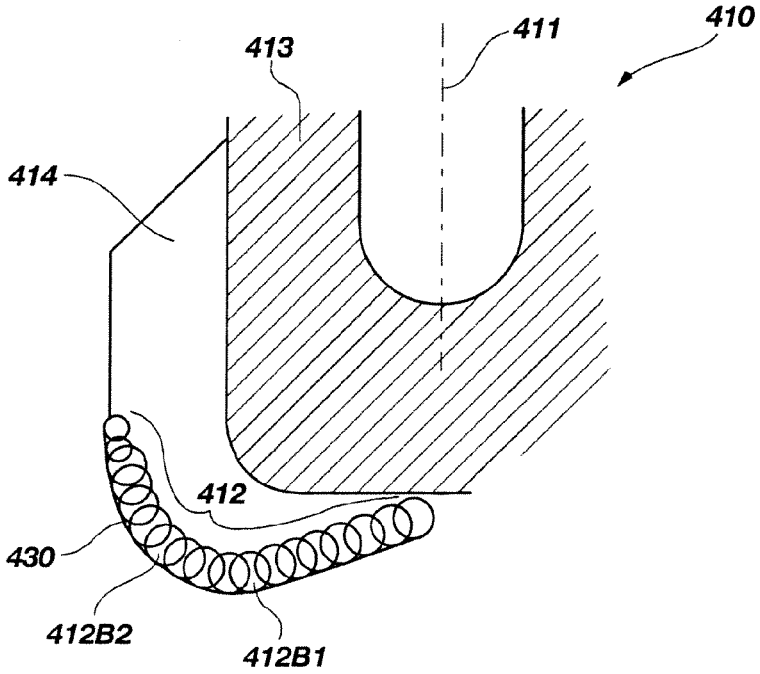
FIG. 3E is a partial schematic side cross-sectional view of the rotary drill bit shown in FIGS. 3C and 3D, as if each of cutting elements were rotated into a single blade.

Thus, rotary drill bit 410 may include both redundant cutting elements 412B1 and 412B2 to avoid damage during drilling of casing shoe 406, cement 420, and boundary surface 403 of formation 440. FIG. 3E shows a partial schematic side cross-sectional view of rotary drill bit 410 as if each of cutting elements 412 were rotated into a single blade 414 along profile 430 in relation to longitudinal axis 411, including both redundant cutting elements 412B1 and 412B2. Such a cutting element configuration upon rotary drill bit 410 may be advantageous in sequentially drilling into the casing shoe 406 and formation 440 as respectively shown in FIGS. 3C and 3D.

Figure 3F:
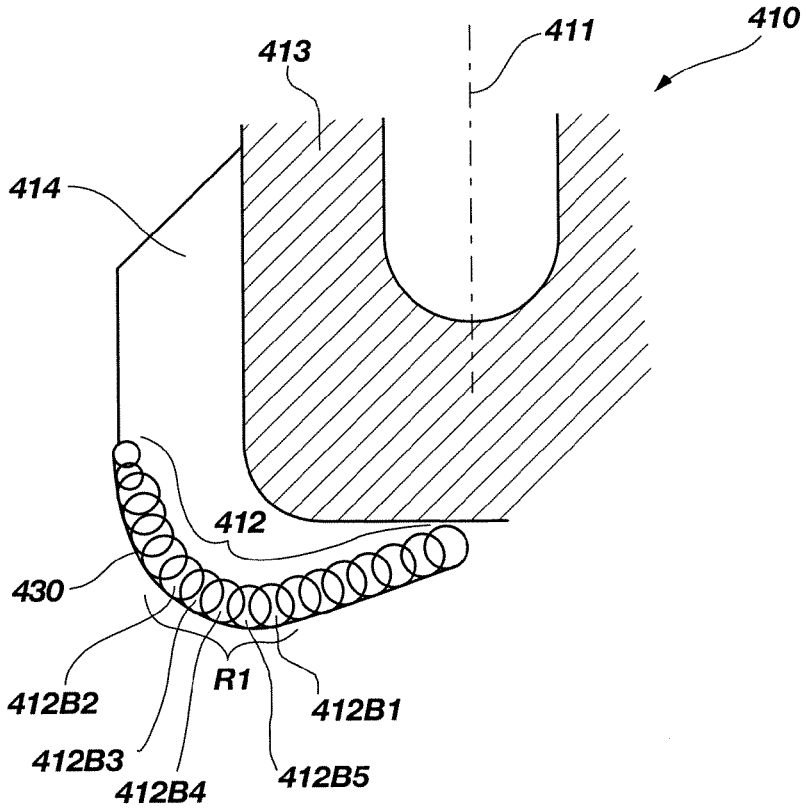
FIG. 3F is a partial schematic side cross-sectional view of a rotary drill bit of the present invention.

Alternatively, a continuous region of profile 430 may include two or more radially adjacent redundant cutting elements. For instance, as shown in FIG. 3F, which shows a partial schematic side cross-sectional view of the rotary drill bit 410 of the present invention, redundant cutting elements 412B1, 412B2, 412B3, 412B4, and 412B5 may be placed radially adjacent one another, respectively, upon profile 430. Such a configuration may effectively protect region R1 from damage when drilling between regions of a material having differing properties. Such a configuration may be desirable for protecting against excessive damage in response to a variety of boundary surface orientations or locations which may be encountered between differing regions of a material being drilled. More generally, a rotary drill bit of the present invention may include one or more regions, each of which includes two or more redundant cutting elements, without limitation.

It should also be noted that any of the redundant cutting elements disposed on a rotary drill bit contemplated by the present invention may be configured to exhibit enhanced durability in relation to other cutting elements disposed thereon. For instance, redundant cutting elements may be disposed at relatively higher backrake angles than other cutting elements disposed on a rotary drill bit.

Figure 3G:
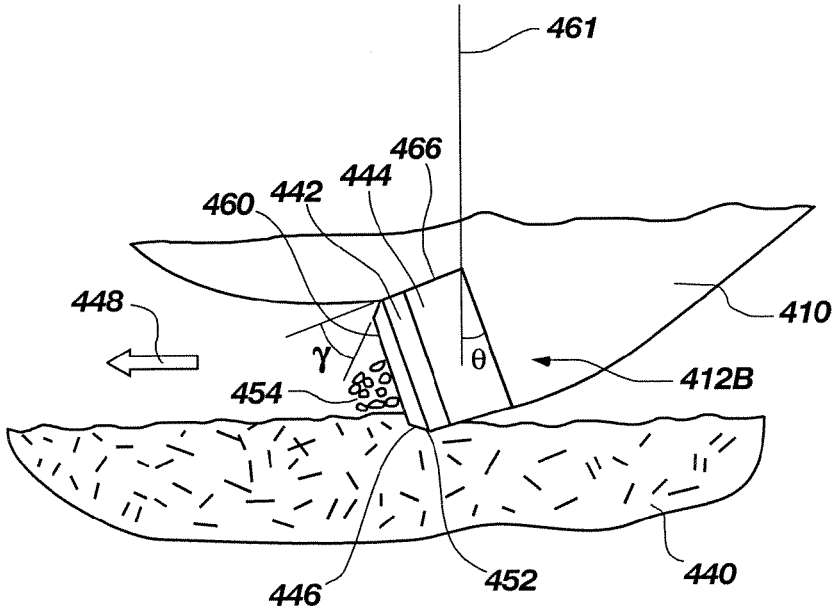
FIG. 3G is schematic cross-sectional view of a redundant cutting element disposed within a rotary drill bit according to the present invention.

Illustratively, FIG. 3G depicts a schematic side cross-sectional view of a redundant cutting element 412B (FIG. 3B) disposed within rotary drill bit 410 during drilling of a subterranean formation 440. The cutting element 412B may include a superabrasive table 442 sintered onto a substrate 444. The superabrasive table 442 may include a chamfer or rake land 446, as described in more detail hereinbelow. Thus, the cutting element 412B may include a cutting face 460, which cuts the formation 440, contacting it along cutting face 460, rake land 446, and at lower cutting edge 452. As the rotary drill bit 410 with cutting element 412B moves generally in the direction indicated by arrow 448, as by mutual rotation and longitudinal translation, as known in the art, the cutting element 412B cuts into subterranean formation 440, generating particles or at least partially continuous chips 454 sliding across the cutting face 460. As shown in FIG. 3G, cutting element 412B is disposed at a backrake angle θ, in relation to vertical reference line 461. Such a configuration is termed "negative backrake," as known in the art. The magnitude of negative backrake angle θ of redundant cutting elements 412B may be greater than the magnitude of negative backrake angle of other cutting elements 412 of rotary drill bit 410. Such a configuration may provide greater durability to redundant cutting elements 412B in relation to cutting elements 412 of rotary drill bit 410.

Alternatively or additionally, the configuration of the redundant cutting elements may be different from other cutting elements disposed on the rotary drill bit. For example, redundant cutting elements may be configured with chamfers, rake lands, or both that improve the durability thereof. One particular configuration for redundant cutting elements may be as disclosed in U.S. Pat. No. 5,881,830 to Cooley, assigned to the assignee of the present invention and the disclosure of which is incorporated in its entirety by reference herein. Another particular embodiment that redundant cutting element 412B may comprise is disclosed in U.S. Pat. No. 5,706,906 to Jurewicz et. al., assigned to the assignee of the present invention and the disclosure of which is incorporated in its entirety by reference herein. Accordingly, a redundant cutting element 412B may include a superabrasive table 442 of about 0.070 to 0.150 inch in thickness, measured along the longitudinal axis of the cutting element 412B between a leading portion of the cutting face 460 and the superabrasive table 442/substrate 444 interface. Further, the periphery of the superabrasive table 442, may include a rake land 446 disposed at a rake land angle γ for engaging and drilling a subterranean formation. The rake land angle may be in the range of 30° to 60° and the length of the rake land may be at least about 0.050 inch, measured from the inner radial extent of the rake land 446 (or the center of the cutting face 460, if the rake land 446 extends thereto) to the side surface 466 of the cutting element 412B along or parallel to (e.g., at the same angle) to the actual surface of the rake land 446.

It is further contemplated by the present invention that the initial engagement between a cutting element of a rotary drill bit and a change in subterranean formation or other material properties may be positioned depending on the orientation and shape of the boundary surface between regions of the subterranean formation, different subterranean formations, or other materials in the path of the rotary drill bit and the orientation of the rotary drill bit as it engages or encounters the boundary surface.

Figures 1, 4A:
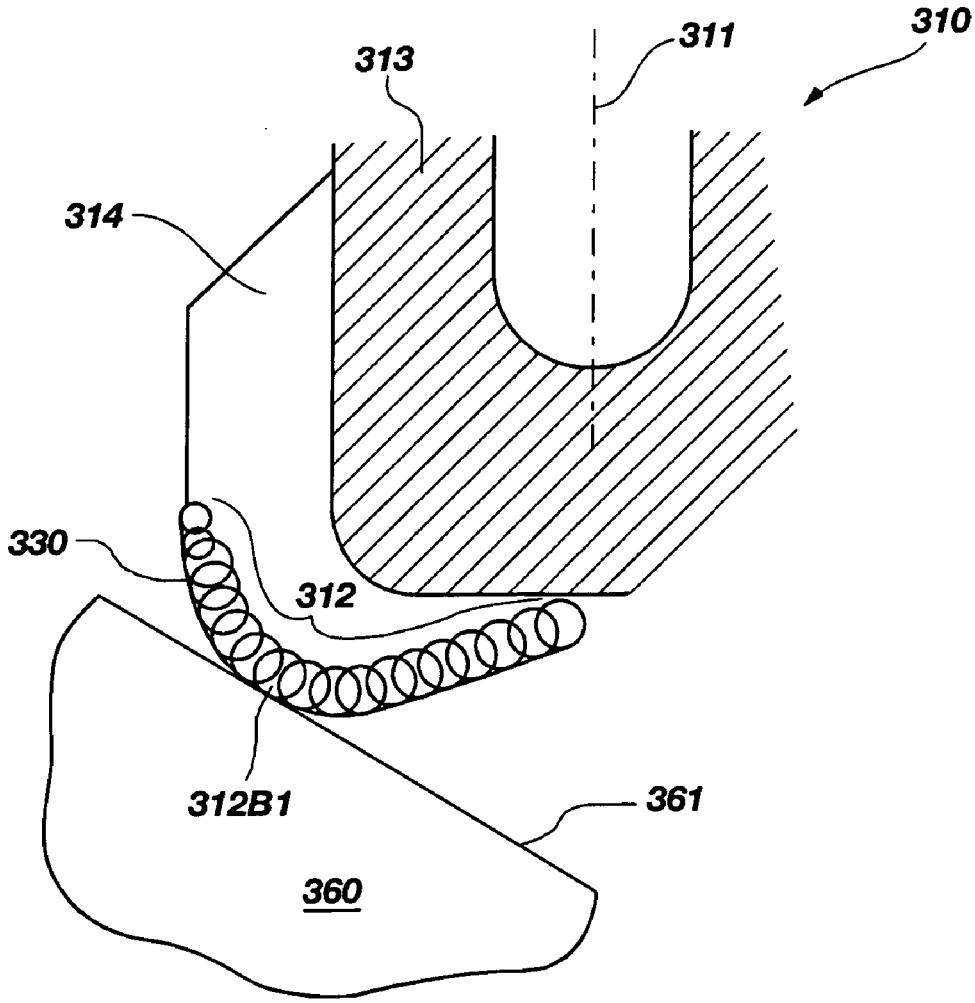
FIG. 4A-1 is a partial side cross-sectional view of an exemplary rotary drill bit of the present invention, as if each of its cutting elements were rotated into a single blade.

FIG. 4A-1 shows a partial schematic side cross-sectional view of rotary drill bit 310 as if each of cutting elements 312 were rotated into a single blade 314 extending from bit body 313 along profile 330 in relation to longitudinal axis 311. Formation region 360 is also shown as having a boundary surface 361 that is substantially planar, and is oriented at an angle with respect to longitudinal axis 311. In such an arrangement, assuming rotary drill bit 310 is drilling along longitudinal axis 311, redundant cutting elements 312 may beneficially contact formation region 360, since the cutting element position of redundant cutting elements 312B1 initially contacts, prior to other cutting elements 312 of rotary drill bit 310, the boundary surface 361 thereof, upon drilling thereinto.

While the above-described embodiments of the boundary surfaces of transitions between regions of different drilling properties have been generally described as exhibiting symmetry about the longitudinal axis of the rotary drill bit drilling thereinto, such symmetry is not necessary to realize benefits via the present invention. More specifically, although redundant cutting elements may share or distribute contact with a boundary surface effectively upon substantially concurrent contact therewith, advantages of redundant cutting elements may also occur if initial contact with a boundary surface is sequential with respect thereto.

For instance, redundant cutting elements that sequentially contact a boundary surface between regions having different properties may reduce the total damage that may occur to a single cutting element at a given cutting element position, because such amount of damage may be distributed among more than one cutting element. Further, more than one contact between redundant cutting elements and a formation region which is harder than the region thereabove may tend to slow progress thereinto, which may reduce the magnitude of the depth of cut that accumulates between periods of non-contact with the harder formation and correspondingly reduce or distribute damage to the redundant cutting elements. Of course, the circumferential position of the cutting elements may be considered, and other cutting element positions may be made redundant so as to prevent overloading to any one cutting element (redundant or non-redundant) of the rotary drill bit 310.

In a further aspect of the present invention, a rotary drill bit may include redundant cutting elements in more than one position, in relation to expected positions of initial engagement of formation changes, wherein at least one expected position of initial contact with formation changes may occur substantially concurrently, while at least another expected position of initial contact may occur substantially sequentially.

Figures 2, 4A:
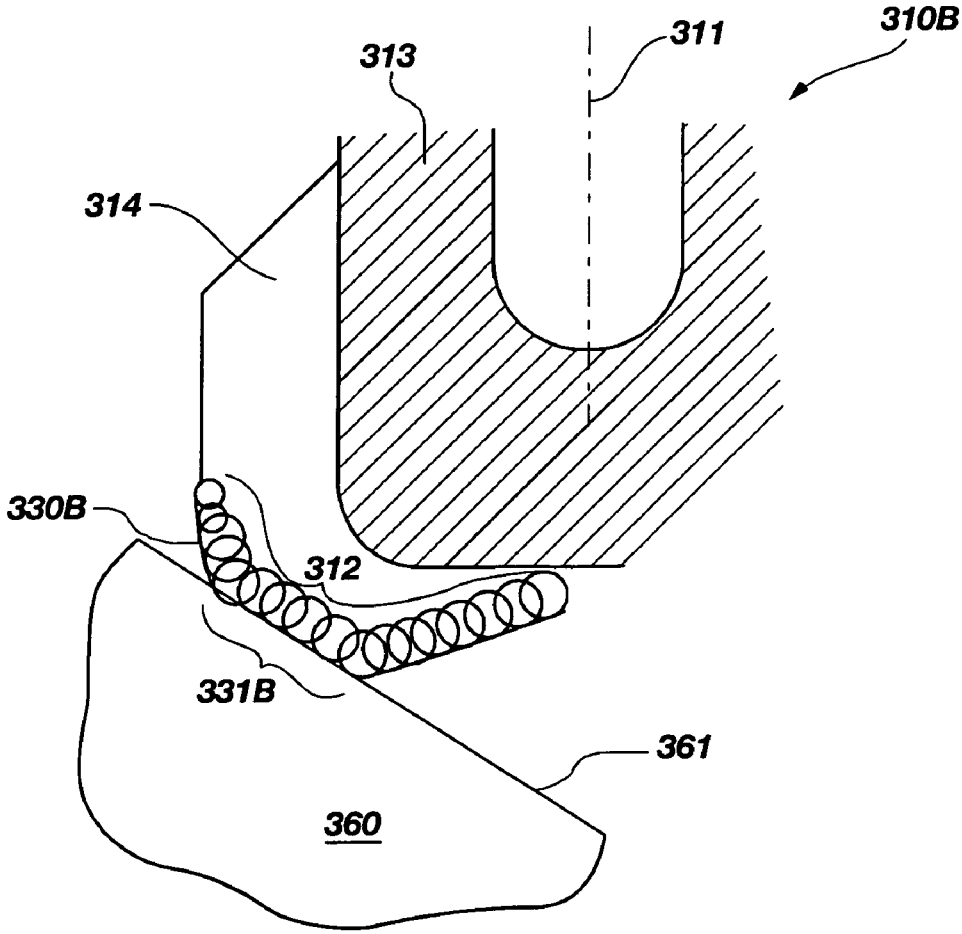

In another aspect of the present invention, a rotary drill bit may be structured for encountering a formation change. Particularly, a profile region may be structured so that cutting elements positioned thereon substantially concurrently contact a boundary surface between adjacent subterranean formations. More generally, according to the present invention, at least a portion of a profile of rotary drill bit may be structured for causing initial contact between a plurality of cutting elements positioned thereon and an anticipated boundary surface of a subterranean formation. Furthermore, according to the present invention, at least a portion of a profile of rotary drill bit may be structured for causing substantially concurrent contact between the plurality of cutting elements positioned thereon and an anticipated boundary surface of a subterranean formation For example, FIG. 4A-2 shows a rotary drill bit 310B having a profile 330B including a region 331B thereof structured for contacting boundary surface 361 of formation region 360. Thus, during use, rotary drill bit 310B may drill into subterranean formation such that region 331B, including a plurality of cutting elements 312, initially contacts boundary surface 361. Explaining further, the plurality of cutting elements 312 within region 331B may, substantially concurrently contact boundary surface 361. Such a configuration may distribute the forces associated with initial contact of boundary surface 361 between the plurality of cutting elements 312 within region 331B. It should be noted that at least some of the plurality of cutting elements 312 within region 331B may be positioned upon different blades of rotary drill bit 310B. Of course, some of the plurality of cutting elements 312 within region 331B may be positioned upon one blade of rotary drill bit 310B. Further, some of the plurality of cutting elements 312 within region 331B may be redundant; or, alternatively, none of the plurality of cutting elements within region 331B may be redundant.

Figures 3, 4A:
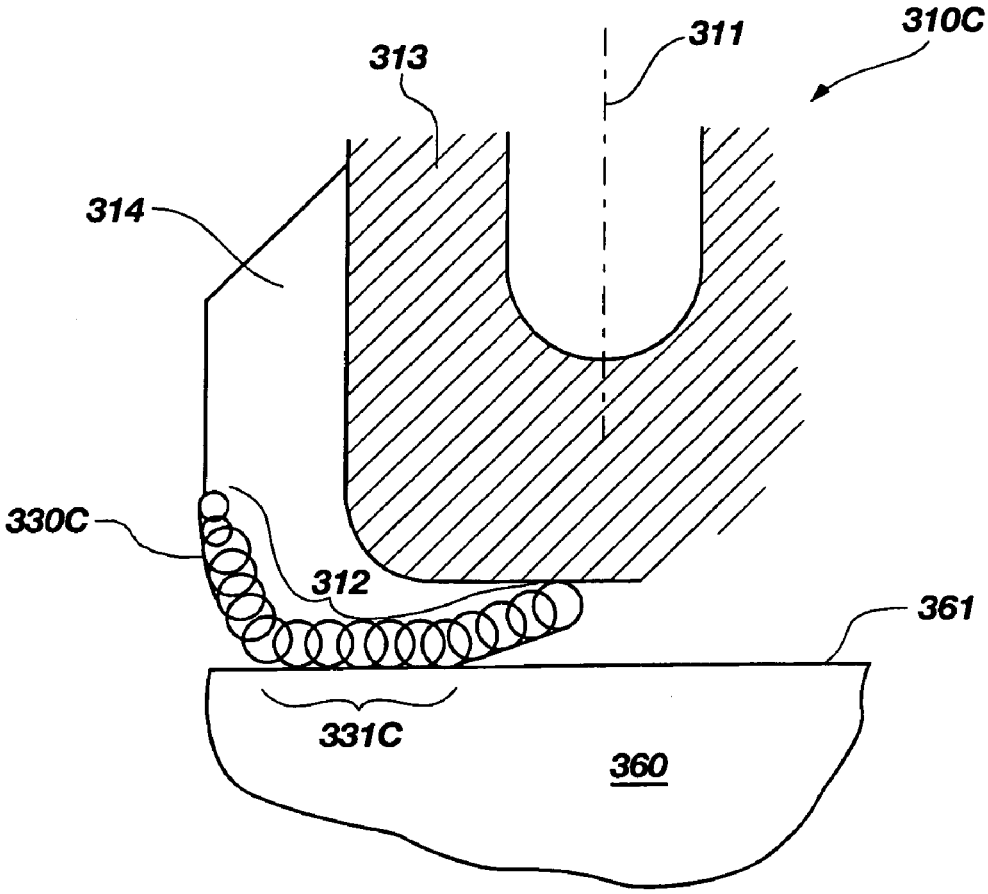

In another example, FIG. 4A-3 shows a rotary drill bit 310C having a profile 330C including a region 331C thereof structured for contacting boundary surface 361 of formation region 360. Thus, during use, rotary drill bit 310C may drill into subterranean formation such that the plurality of cutting elements 312 within region 331C initially contact boundary surface 361. The plurality of cutting elements within region 331C may be structured and positioned in relation to boundary surface 361 of subterranean formation 360 in a manner as discussed above with respect to FIG. 4A-2. Particularly, the plurality of cutting elements 312 within region 331C may, substantially concurrently contact boundary surface 361. Such a configuration may distribute the forces associated with initial contact of boundary surface 361 between the plurality of cutting elements 312 within region 331C. It may be appreciated that although both regions 331B and 331C (FIGS. 4A-2 and 4A-3) are depicted as corresponding to a substantially planar-shaped (in cross-section) boundary surface 361 of a portion of subterranean formation 360, the present invention is not so limited. Rather, according to the present invention, a region of a rotary drill bit may be structured for carrying a plurality of cutting elements for substantially concurrently contacting an arcuately shaped (in cross-section) (e.g., circular, oval, ellipsoid, hemispherical, rounded, etc.) boundary surface 361 of a portion of a subterranean formation.

It should be recognized that positions of cutting elements 312 for initial engagement with a boundary surface may vary due to manufacturing limitations or for other reasons. Thus, the actual position of cutting elements 312 (e.g., within region 331B and 331C) may be within about ±0.020 inch of a desired placement (i.e., substantially planar or along an arcuate profile). Accordingly, cutting elements 312 may be placed substantially at a position for initial engagement with a formation according to the present invention.

Figure 4B:
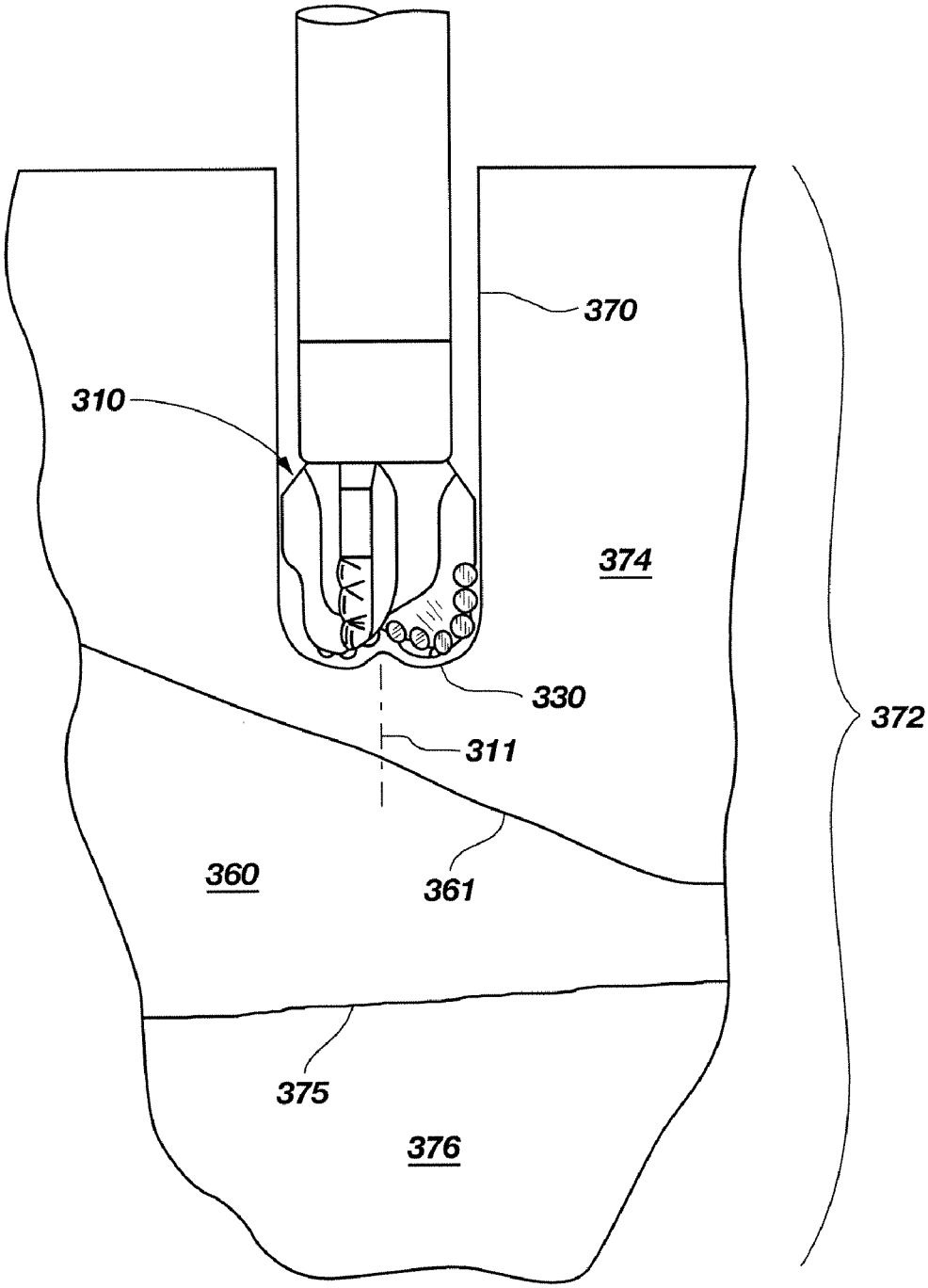
FIG. 4B is a schematic side view of an exemplary rotary drill bit of the present invention during drilling a borehole into a formation.
Figure 4C:
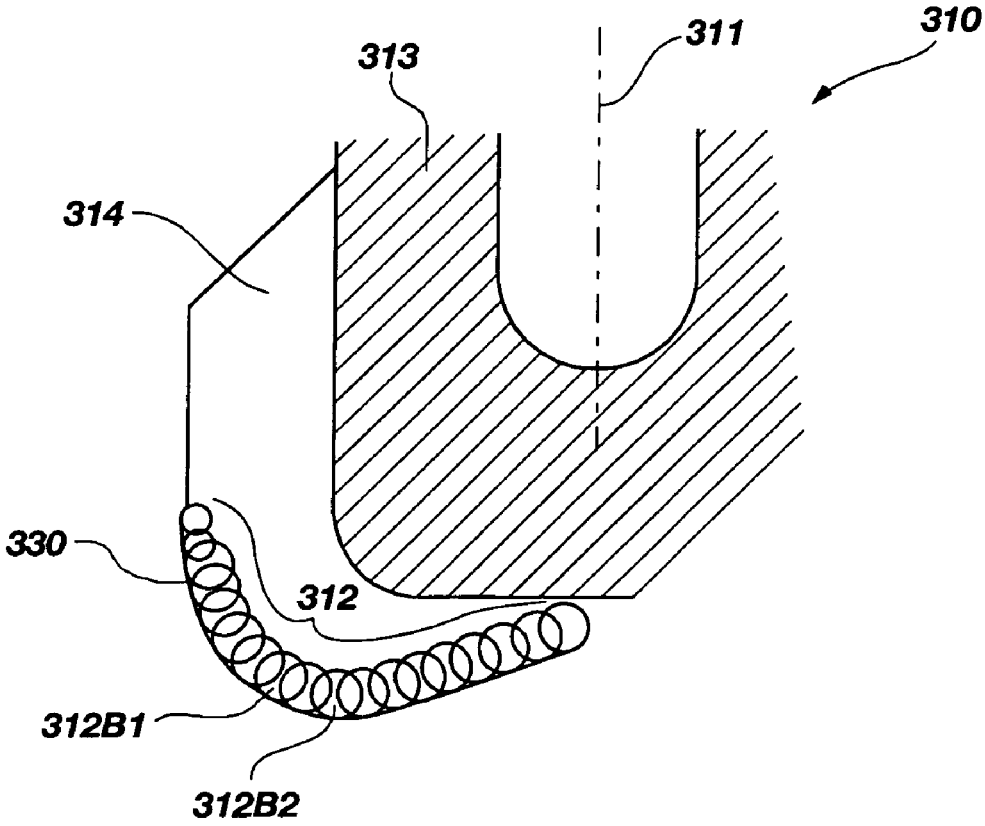
FIG. 4C is a partial schematic side cross-sectional view of the rotary drill bit shown in FIG. 4B, as if each of cutting elements were rotated into a single blade.

Rotary drill bits according to the present invention may be advantageous for drilling into subterranean formations having different regions or properties. For example, FIG. 4B shows a schematic side view of rotary drill bit 310 drilling borehole 370 within formation 372. Formation 372 comprises region 374, region 360, and region 376, wherein region 374 and region 360 are adjacent to one another along boundary surface 361, while region 360 and region 376 are adjacent one another along boundary surface 375. Rotary drill bit 310 may be configured to engage each of boundary surfaces 361 and 375 with differently radially positioned redundant cutting elements. To this end, FIG. 4C shows a partial schematic side cross-sectional view of rotary drill bit 310 as if each of cutting elements 312 were rotated into a single blade 314 along profile 330 in relation to longitudinal axis 311. Redundant cutting elements 312B1 may be beneficial with respect to drilling into the boundary surface 361 between region 374 and region 360, while redundant cutting elements 312B2 may be beneficial with respect to drilling into the boundary surface 375 between region 360 and region 376. Alternatively, at least a portion of the profile (not shown) of rotary drill bit 310 may be configured as discussed above (e.g., in relation to FIGS. 4A-2 and 4A-3), wherein a profile thereof includes a region having a plurality of cutting elements structured for contacting boundary surface 361 of formation region 360 substantially concurrently.

As described above, since boundary surface 361 may not be symmetric about longitudinal axis 311, so initial contact therewith by redundant cutting elements 312B 1 (or a region having a plurality of cutting elements as discussed in relation to FIGS. 4A-2 and 4A-3) may be substantially sequential, while initial contact with boundary surface 375, which may be substantially symmetric about longitudinal axis 311, by redundant cutting elements 312B2 may be substantially concurrent. Of course, many alternatives are possible, limited only by a drilling profile geometry of a rotary drill bit and a direction of drilling therewith, in relation to a boundary surface geometry intersecting therewith.

Turning to a design aspect of a rotary drill bit 310 according to the present invention, the existence and drilling characteristics of regions 374, 360, and 376 of formation 372 may be known prior to drilling thereinto, in which case rotary drill bit 310 may be designed specifically to include redundant cutting elements 312B1 and 312B2 at the positions of initial engagement therewith, depending on the orientation thereof as well as the anticipated direction of drilling thereinto. Alternatively, a rotary drill bit may be designed specifically to include cutting elements 312 within a selected profile region (as shown in FIGS. 4A-2 and 4A-3) at a position of initial engagement with a boundary surface, depending on the orientation thereof as well as the anticipated direction of drilling thereinto. More specifically, boundary surfaces 361 and 375 between different regions 374, 360, and 376 of formation 372 may be determined, as by logging, seismic measurements, or as otherwise known in the art. Also, an anticipated drilling path (not shown) may be selected for drilling into and through boundary surfaces 361 and 375 between different regions 374, 360, and 376 of formation 372.

Analyzing the anticipated drilling path (not shown) with respect to boundary surfaces 361 and 375 between different regions 374, 360, and 376 of formation 372 and further in relation to a selected cutting element profile 330, may indicate at least one cutting element position that contacts at least one of the boundary surfaces 361 and 375 prior to other cutting elements 312. Accordingly, redundant cutting elements 312B1 or 312B2, or other redundant cutting elements, may be placed, by design, at the indicated cutting element positions according to predicted or assumed boundary surfaces in a selected structure to be drilled. Alternatively, a plurality of cutting elements positioned upon at least a portion of the profile (not shown) of rotary drill bit 310 may be configured as discussed above (e.g., in relation to FIGS. 4A-2 and 4A-3) for contacting boundary surface 361 of formation region 360 substantially concurrently. Of course, cutting element profiles and individual cutting element positions may be modified during the design process, as desired. An analogous design process may also apply to design of a rotary drill bit for drilling through a casing shoe, associated cement, and into a subterranean formation, as described above, without limitation.

Alternatively, in a further aspect of the present invention, a rotary drill bit of the present invention may be directionally drilled into a formation with different regions which are oriented differently so as to contact the formation changes or boundary surfaces with redundant cutting elements. It may be desirable to minimize or at least limit the redundant cutting elements included by a rotary drill bit. One reason for limiting redundancy of cutting elements upon a rotary drill bit may be simply a consideration of space in relation to the number of blades, spacing thereof, and the size of the rotary drill bit. Additional reasons for limiting redundant cutting elements may be that redundant cutting elements may decrease drilling efficiency or decrease drilling aggressiveness. The present invention, therefore, contemplates a method of drilling a subterranean formation that includes modifying a drilling direction to engage a boundary between regions of the formation so as to initially engage or contact a boundary with redundant cutting elements. Such a method of drilling may reduce the redundant cutting elements that are needed to effectively drill into a formation with different regions.

Figure 5A:
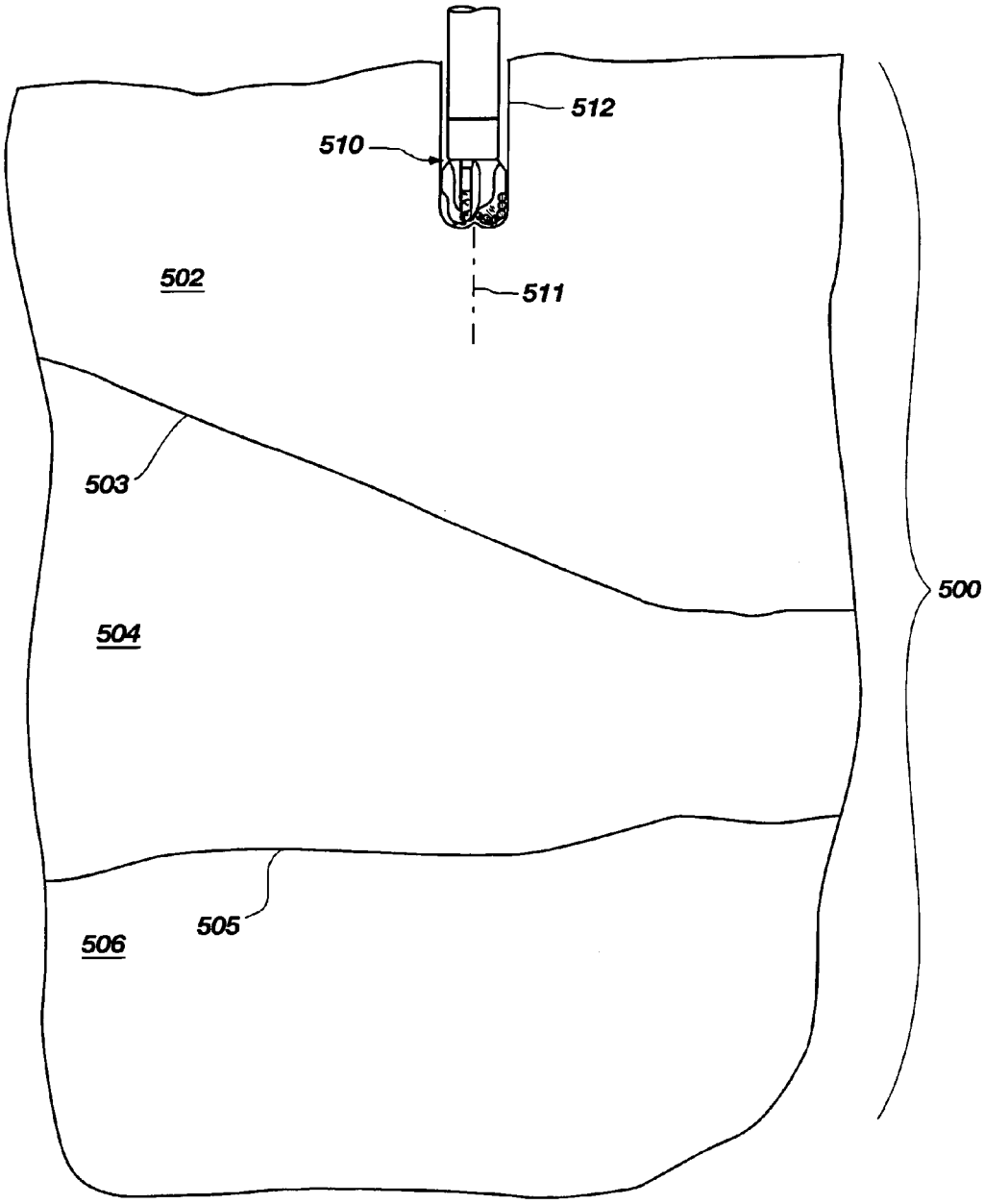
FIG. 5A is a schematic side view of an exemplary rotary drill bit of the present invention during drilling a borehole to a first depth within a formation.
Figure 5B:
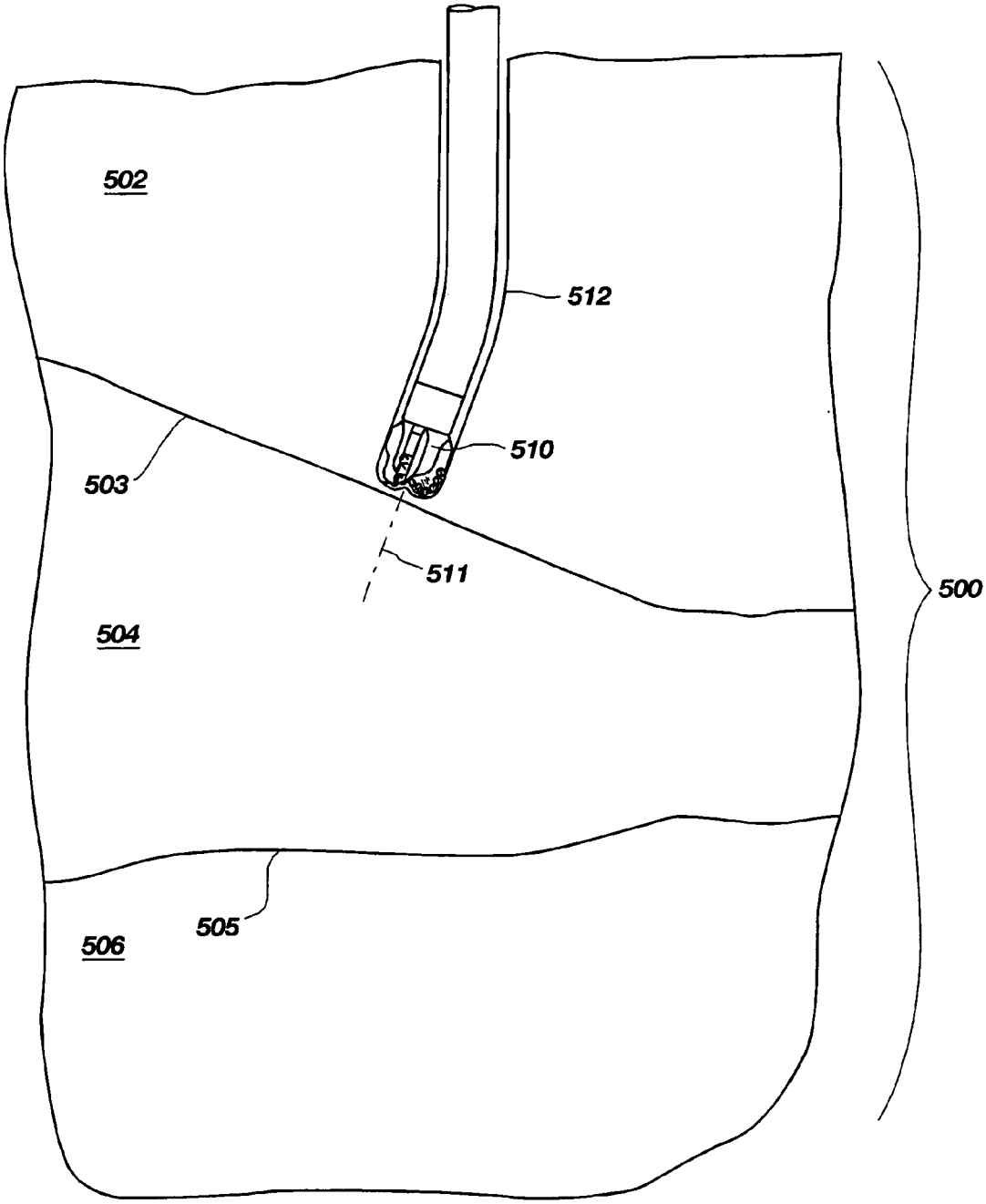
FIG. 5B is a schematic side view of an exemplary rotary drill bit of the present invention during drilling a borehole to a second depth within the formation shown in FIG. 5A.
Figure 5C:
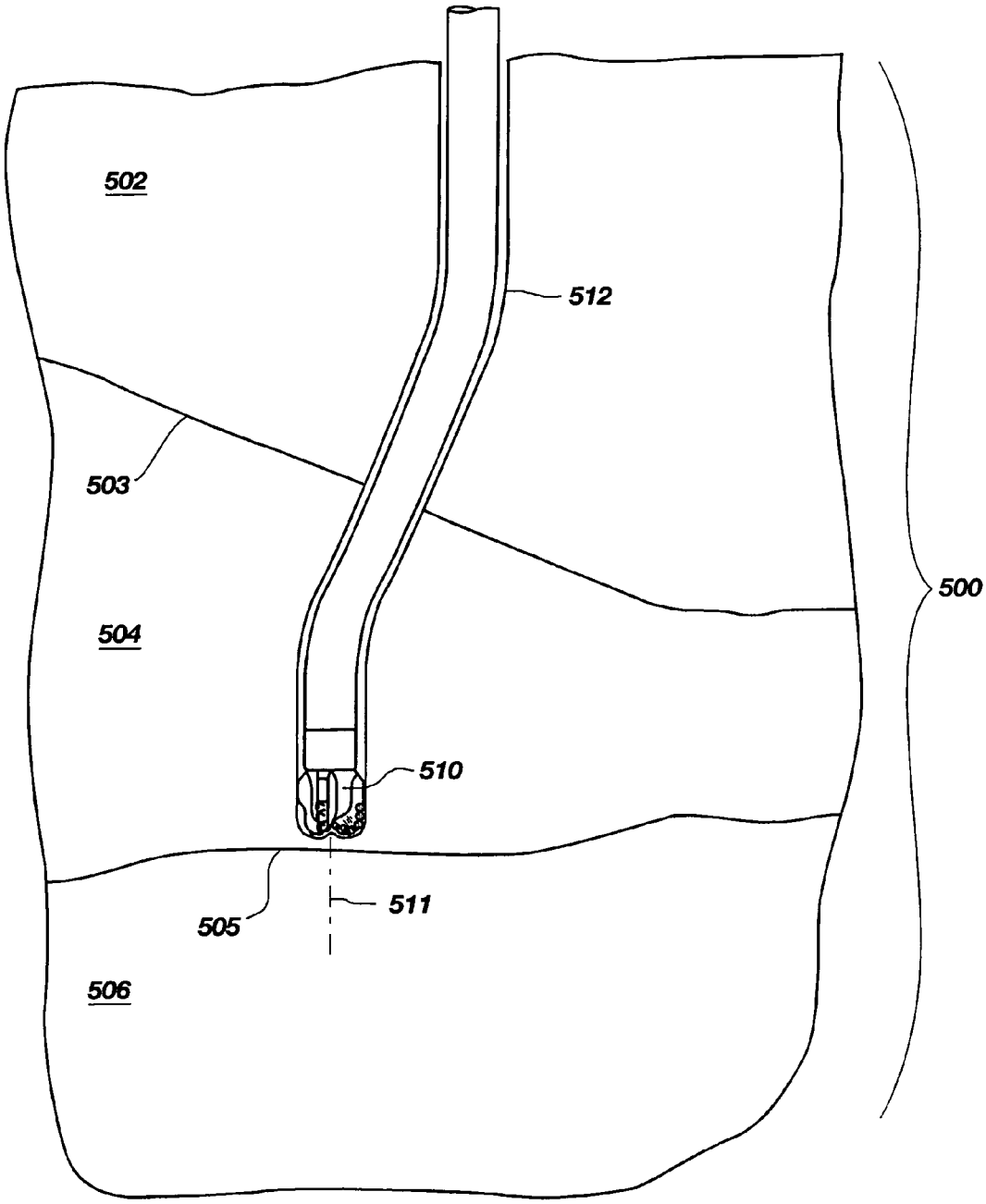
FIG. 5C is a schematic side view of an exemplary rotary drill bit of the present invention during drilling a borehole to a third depth within the formation shown in FIGS. 5A and 5B.

Particularly, FIGS. 5A-5C show a rotary drill bit 510 of the present invention drilling into formation 500 and forming borehole 512 therein as it progresses through regions 502, 504, and 506. Regions 502 and 504 are adjacent one another along boundary surface 503, while regions 504 and 506 are adjacent one another along boundary surface 505. Rotary drill bit 510 may include cutting elements 212 and redundant cutting elements 212B positioned and configured as described in relation to rotary drill bit 210 as shown in FIGS. 2B and 2C, so that redundant cutting elements 212B may initially engage boundary surfaces 503 and 505 if the longitudinal axis 511 (drilling axis) of rotary drill bit 510 is oriented substantially perpendicular thereto as it contacts therewith. Alternatively, a plurality of cutting elements 212 positioned upon at least a portion of the profile (not shown) of rotary drill bit 510 may be configured as discussed above (e.g., in relation to FIGS. 4A-2 and 4A-3) for contacting boundary surface 361 of formation region 360 substantially concurrently.

Therefore, with reference to FIG. 5B, it may be seen that the orientation of longitudinal axis 511 of rotary drill bit 510 may be altered or changed during drilling of borehole 512 so that redundant cutting elements 212B disposed thereon initially engage boundary surface 503. Further, as shown in FIG. 5C, the orientation of the drilling direction or longitudinal axis 511 of rotary drill bit 510 may be altered or changed during drilling of borehole 512 so that redundant cutting elements 212B disposed thereon initially engage boundary surface 505. Changing the orientation or drilling direction of rotary drill bit 510 may be accomplished by directional drilling methods and apparatus as known in the art. Such a method of drilling may advantageously protect the cutting elements 212 disposed on the rotary drill bit 510 during drilling through boundary surfaces 503 and 505 between regions 502, 504, and 506 of formation 500 while also facilitating enhanced drilling performance within regions 502, 504, and 506 of formation 500.

With reference to FIGS. 5A-5C, in order to selectively orient the direction of drilling, the orientation, position, or both of the boundary surfaces 503 and 505 must be at least partially determined. There may be several ways to at least partially determine the orientation, position, or both of boundary surfaces 503 and 505. For instance, boundary surfaces 503 and 505 may be at least partially determined by logging another hole that is drilled though the formation regions, by seismic measurements, by measurement while drilling systems, as known in the art, or by a combination of the foregoing techniques. The determinations of such systems may be considered during the operation of drilling with drill bit 510 and the direction of drilling (orientation of longitudinal axis 511) may be modified accordingly.

In yet a further aspect of the present invention, redundant cutting elements according to the present invention may be configured so as to maintain or preserve a stability characteristic of the rotary drill bit during the initial drilling engagement of a region.

Generally, three approaches to realizing drilling stability have been practiced. The first two stability approaches involve configuring the rotary drill bit with a selected lateral imbalance force configuration. Particularly, a so-called anti-whirl design or high-imbalance concept typically endeavors to generate a directed net lateral force (i.e., the net lateral force being the summation of each of the lateral drilling forces generated by each of the cutting elements disposed on a rotary drill bit) toward a gage pad or bearing pad that slidingly engages the wall of the borehole. Such a configuration may tend to stabilize a rotary drill bit as it progresses through a subterranean formation. Further, a so-called low-imbalance design concept endeavors to significantly reduce, if not eliminate, the net lateral force generated by the cutting elements so that the lateral forces generated by each of the cutting elements substantially cancel one another. In a further stability approach, grooves may be formed into the formation, by selective, radially spaced placement of cutting elements upon the rotary drill bit. Accordingly, the grooves or kerfs may tend to mechanically inhibit the rotary drill bit from vibrating or oscillating during drilling. Of course, grooves or kerfs may not effectively stabilize the rotary drill bit if the magnitude of the net lateral force becomes large enough, or if torque fluctuations become large enough. It should also be noted that the aforementioned stability approaches are typically developed and analyzed in reference to drilling of a homogeneous material or homogeneous subterranean formation.

Regardless of the stability approach which may be employed, it is recognized by the present invention that transition into a region of different drilling characteristics may adversely affect the stability approach so employed. More specifically, as the redundant cutting elements or cutting elements within a selected region of a rotary drill bit of the present invention initially engage a region with different drilling characteristics than the rest of the cutting elements thereon, the net lateral force as well as the torque may be altered, which may deleteriously influence the stability characteristics of the rotary drill bit, which may be typically designed according to the assumption of homogeneity of the material to be drilled.

Therefore, the present invention contemplates that the net lateral force of a group of redundant cutting elements may be minimized or oriented within a given range of directions. In one embodiment, the redundant cutting elements or cutting elements within a selected region of a profile may be sized and configured to generate individual lateral forces that at least partially cancel with one another. Put another way, the vector addition of each lateral force of the at least two redundant cutting elements or cutting elements within a selected region of a profile may be smaller than the arithmetic summation of the magnitude of each of the lateral forces. Alternatively, redundant cutting elements or cutting elements within a selected region of a profile may be sized and configured to generate individual lateral forces that are relatively small in relation to the net lateral force produced by the other cutting elements disposed upon a rotary drill bit. Similarly, redundant cutting elements or cutting elements within a region of a profile may be positioned and configured so as to generate a net lateral imbalance force in a given direction or within a selected range of directions.

As known in the art, the geometry, backrake angle, siderake angle, exposure, size, and position of a cutting element disposed on a rotary drill bit may influence the forces and torques that are generated by drilling therewith. As further known in the art, predictive models and simulations may be employed to estimate or predict such forces and torque values or magnitudes in relation to a selected rotary drill bit design and material to be drilled.

Figure 6A:
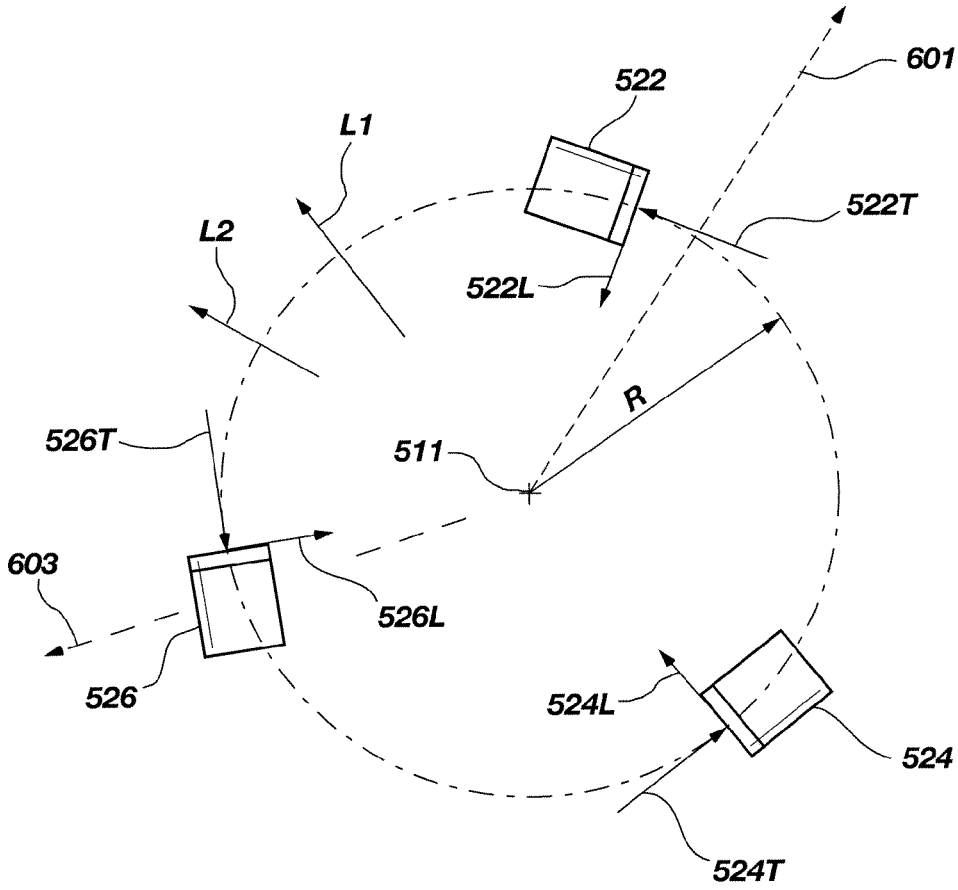
FIG. 6A is a partial schematic top elevation cutter layout view of one embodiment of a rotary drill bit according to the present invention.

Therefore, now referring to FIG. 6A, which shows a partial schematic top elevation cutter layout view of a rotary drill bit (not shown) of the present invention, redundant cutting elements 522, 524, and 526 may be sized, positioned, and configured to minimize or reduce the net lateral force, the net torque, or combinations thereof that may be produced by drilling therewith. Particularly, by initial engagement with a region of a drilling structure, such as different regions of a subterranean formation or different regions of casing assemblies. In more detail, the forces that are produced by associated redundant cutting elements 522, 524, and 526 are labeled as lateral (or radial) forces 522L, 524L, and 526L, respectively, while tangential forces are labeled 522T, 524T, and 526T, respectively. Of course, it should be understood that both the tangential and radial forces influence an overall lateral imbalance force, as is known in the art.

Thus, redundant cutting elements 522, 524, and 526 may be sized and configured so that lateral forces 522L, 524L, 526L, and tangential forces 522T, 524T, and 526T substantially cancel (via vector addition) in combination with one another. Put another way, the net lateral force, by vector addition of forces of each of redundant cutting elements 522, 524, and 526 may have a relatively small magnitude or may have substantially no magnitude. Alternatively, redundant cutting elements 522, 524, and 526 may be sized and configured to generate individual forces that at least partially cancel with one another or have a magnitude that is relatively small in relation to the magnitude of net lateral force produced by the other cutting elements disposed upon a rotary drill bit. More specifically, the magnitude of the overall lateral imbalance of the rotary drill bit (when drilling a homogeneous formation region) may be changed by less than about 20% during initial engagement by redundant cutting elements 522, 524, and 526 of a different region of a structure in relation to the magnitude of lateral imbalance exhibited when drilling a homogeneous region.

Alternatively, the magnitude of the imbalance force of the redundant cutting elements 522, 524, and 526 may not be limited. However, as discussed hereinbelow, if the net imbalance force of redundant cutting elements 522, 524, and 526 is oriented in a desired direction, it may be preferable to maintain a selected imbalance force direction exhibited by the drill bit for maintaining stability thereof.

In another aspect of the present invention, the overall direction of the imbalance force of redundant cutting elements 522, 524, and 526, may be within ±70° with respect to a net imbalance direction exhibited by the bit when drilling a homogeneous region. Such a configuration may be advantageous for maintaining a desired direction of an imbalance force exhibited by a drill bit during drilling into a subterranean formation having differing regions. For example, as shown in FIG. 6A, a net lateral imbalance force L1 may be generated when the drill bit drills a homogeneous formation. Further, a net imbalance force L2 (of redundant cutting elements 522, 524, and 526) may be generated when redundant cutting elements 522, 524, and 526 engage a boundary surface between two different regions of a subterranean formation, and L2 may have a direction within ±70° of the direction of L1, as illustrated by reference lines 601 and 603.

Figure 6B:
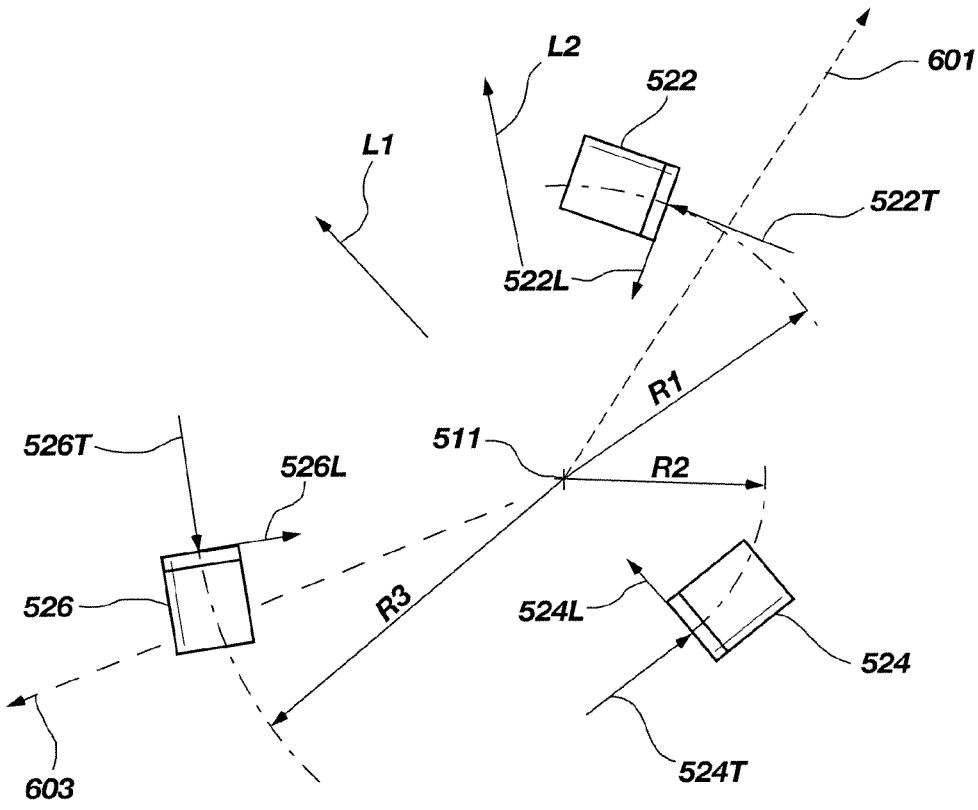
FIG. 6B is a partial schematic top elevation cutter layout view of another embodiment of a rotary drill bit according to the present invention.

Alternatively, cutting elements 522, 524, and 526 may not be redundant and may be positioned upon at least a portion of the profile (not shown) of rotary drill bit 510 configured as discussed above (e.g., in relation to FIGS. 4A-2 and 4A-3). Explaining further, cutting elements 522, 524, and 526 may be positioned at different radial positions R1, R2 R3 as shown in FIG. 6B.

For example, cutting elements 522, 524, and 526 may be sized and configured so that lateral forces 522L, 524L, and 526L, and tangential forces 522T, 524T, and 526T substantially cancel (via vector addition) in combination with one another. Put another way, the net lateral force, by vector addition of lateral forces 522L, 524L, and 526L, and tangential forces 522T, 524T, and 526T may have a relatively small magnitude or may have substantially no magnitude. Alternatively, cutting elements 522, 524, and 526 may be sized and configured to generate individual lateral forces that at least partially cancel with one another or have a magnitude that is relatively small in relation to the magnitude of net lateral force produced by the other cutting elements disposed upon a rotary drill bit. More specifically, the magnitude of the overall lateral imbalance of the rotary drill bit may be changed by less than about 20% during initial engagement by cutting elements 522, 524, and 526 of a different region of a structure in relation to the magnitude of lateral imbalance exhibited when drilling a homogeneous region. On the other hand, alternatively, if the net imbalance force of redundant cutting elements 522, 524, and 526 is oriented in a desired direction, it may be preferable to maintain a selected imbalance of the drill bit for maintaining stability thereof.

Accordingly, in another aspect of the present invention, the overall direction of the imbalance force of cutting elements 522, 524, and 526, may be within ±70° with respect to a net imbalance direction exhibited by the bit when drilling a homogeneous region. Such a configuration may be advantageous for maintaining a desired direction of imbalance of a drill bit during drilling into different subterranean formations. For example, as shown in FIG. 6B, a net lateral imbalance force L1 may be generated when the drill bit drills into a homogeneous formation. Further, a net imbalance force L2 (of cutting elements 522, 524, and 526) may be generated when cutting elements 522, 524, and 526 engage a boundary surface between two different regions of a subterranean formation, and L2 may have a direction within ±70° of the direction of L1, as illustrated by reference lines 601 and 603.

Although specific embodiments have been shown by way of example in the drawings and have been described in detail herein, the invention may be susceptible to various modifications, combinations, and alternative forms. Therefore, it should be understood that the invention is not intended to be limited to the particular forms disclosed. Rather, the invention includes all modifications, equivalents, combinations, and alternatives falling within the spirit and scope of the invention as defined by the following appended claims.

What is claimed is:

1. A drilling tool for drilling a subterranean formation, comprising:

a longitudinal axis;

a body having a face including a plurality of cutting elements disposed thereon;

wherein at least two cutting elements of the plurality are redundant and disposed at a backrake angle having a magnitude greater than a magnitude of a backrake angle of at least each cutting element of the plurality of cutting elements immediately adjacent the at least two cutting elements in a cutting element profile of the plurality of cutting elements; and wherein the at least two redundant cutting elements are positioned at an anticipated location of first contact of the drilling tool with a predicted boundary surface, the predicted boundary surface defined between two regions of the subterranean formation having at least one different drilling characteristic.

2. The drilling tool of claim 1, wherein the drilling tool comprises at least one of a rotary drill bit, a reamer, a reaming wing, a bi-center bit, and a casing bit.

3. The drilling tool of claim 1, wherein the at least two redundant cutting elements are positioned to substantially concurrently contact the predicted boundary surface.

4. The drilling tool of claim 1, wherein at least one of the plurality of cutting elements comprises a polycrystalline diamond compact.

5. The drilling tool of claim 4, wherein each of the at least two redundant cutting elements comprises a superabrasive table having a thickness of between about 0.070 to 0.150 inch.

6. The drilling tool of claim 5, wherein each of the at least two redundant cutting elements includes at least one of a rake land and a chamfer.

7. The drilling tool of claim 6, wherein each of the at least two redundant cutting elements includes a rake land oriented at a rake land angle between 30° to 60° relative to a side wall of the at least two redundant cutting elements, respectively, and having a length of at least about 0.050 inch.

8. The drilling tool of claim 1, wherein the at least two redundant cutting elements are disposed at a backrake angle having a magnitude greater than a magnitude of a backrake angle of each of the remaining plurality of cutting elements disposed on the drilling tool.

9. The drilling tool of claim 1, wherein the predicted boundary surface comprises a plane, oriented substantially perpendicular to the longitudinal axis of the drilling tool at the time of first contact of the drilling tool therewith.

10. The drilling tool of claim 9, wherein the at least two redundant cutting elements are positioned to substantially concurrently contact the predicted boundary surface.

11. The drilling tool of claim 1, further comprising:

at least two other redundant cutting elements positioned to contact another anticipated location of first contact of the drilling tool with another predicted boundary surface;

wherein the another predicted boundary surface is defined between two other regions of the subterranean formation having at least one different drilling characteristic;

wherein the at least two other redundant cutting elements are positioned at a different radial position than the at least two redundant cutting elements.

12. The drilling tool of claim 11, wherein the at least two redundant cutting elements and the at least two other redundant cutting elements are positioned radially adjacent one another.

13. The drilling tool of claim 1, wherein each of the at least two redundant cutting elements are sized and configured for generating a lateral force, wherein a vector summation of the magnitude of each lateral force of the at least two redundant cutting elements is smaller than the arithmetic summation of the magnitude of each lateral force of the at least two redundant cutting elements.

14. The drilling tool of claim 13, wherein the vector summation of each lateral force associated with the at least two redundant cutting elements is less than about 20% of a vector summation of the lateral force of each of the plurality of cutting elements.

15. The drilling tool of claim 1, wherein the vector summation of each lateral force associated with the at least two redundant cutting elements exhibits a direction within ±70° of an imbalance force direction exhibited by the drill bit when drilling a homogeneous formation.

16. A method of operating a drilling tool, comprising:

providing a drilling tool including a plurality of cutting elements, wherein at least two cutting elements of the plurality are redundant;

orienting the at least two redundant cutting elements at a backrake angle greater than a backrake angle of at least each cutting element of the plurality of cutting elements immediately adjacent the at least two redundant cutting elements in a cutting element profile of the plurality of cutting elements;

predicting a boundary surface defined between two abutting regions of a subterranean formation, the two abutting regions having at least one different drilling characteristic;

determining a drilling path, the drilling path oriented for positioning the redundant cutting elements at an anticipated location of first contact of the drilling tool with a predicted boundary surface upon drilling generally therealong; and drilling into the predicted boundary surface generally along the orientation of the anticipated drilling path.

17. The method of operating a drilling tool of claim 16, wherein drilling into the predicted boundary surface comprises drilling into at least one of a casing shoe and cement.

18. The method of operating a drilling toot of claim 16, wherein drilling into the predicted boundary surface comprises drilling into different subterranean constituents.

19. The method of operating a drilling tool of claim 16, wherein drilling into the boundary surface between the two regions of the subterranean formation with the at least two redundant cutting elements changes the magnitude of lateral imbalance of the drilling tool by less than about 20%.

20. The method of operating a drilling tool of claim 16, wherein drilling into the boundary surface between the two regions of the subterranean formation with the at least two redundant cutting elements generates a net lateral force associated therewith that is oriented in a direction within ±70° of a direction of an overall imbalance force of the drilling tool when drilling a homogeneous formation.

21. The method of operating a drilling tool of claim 16, wherein drilling into the predicted boundary surface comprises substantially concurrently contacting the boundary surface with the at least two redundant cutting elements.

22. The method of operating a drilling tool of claim 16, further comprising;

determining at least one of the orientation and position of the drilling tool in relation to the anticipated drilling path.

23. The method of operating a drilling tool of claim 22, further comprising:

aligning a drilling direction of the drilling tool generally along the orientation of the anticipated drilling path prior to drilling into the predicted boundary surface.

24. A drilling tool for drilling a subterranean formation, comprising:

a longitudinal axis;

a body having a face including a plurality of cutting elements disposed thereon;

wherein at least a portion of the face is structured for causing initial contact between at least two redundant cutting elements of the plurality of cutting elements and a predicted boundary surface of a subterranean formation, the at least two redundant cutting elements being disposed at a backrake angle having a magnitude greater than a magnitude of a backrake angle of at least each cutting element of the plurality of cutting elements immediately adjacent the at least two redundant cutting elements in a cutting element profile of the plurality of cutting elements.

25. The drilling tool of claim 24, wherein the drilling tool comprises at least one of a rotary drill bit, a reamer, a reaming wing, a bi-center bit, and a casing bit.

26. The drilling tool of claim 24, wherein the at least two redundant cutting elements are positioned to substantially concurrently contact the predicted boundary surface.

27. The drilling tool of claim 24, wherein at least one of the at least two redundant cutting elements comprises a polycrystalline diamond compact.

28. The drilling tool of claim 24, wherein the at least two redundant cutting elements are disposed at a backrake angle having a magnitude greater than a magnitude of a backrake angle of each of the remaining at least two redundant cutting elements disposed on the drilling tool.

29. The drilling tool of claim 24, wherein each of the at least two redundant cutting elements comprises a superabrasive table having a thickness of between about 0.070 to 0.150 inch.

30. The drilling tool of claim 29, wherein each of the at least two redundant cutting elements includes at least one of a rake land and a chamfer.

31. The drilling tool of claim 30, wherein each of the at least two redundant cutting elements includes a rake land oriented at a rake land angle between 30° to 60° relative to the side wall of the at least two redundant cutting elements, and having a length of at least about 0.050 inch.

32. The drilling tool of claim 24, wherein the predicted boundary surface comprises a plane oriented substantially perpendicular to the longitudinal axis of the drilling tool.

33. The drilling tool of claim 24, wherein the vector summation of each lateral force associated with the at least two redundant cutting elements is less than about 20% of a vector summation of the lateral force of each of the at least two redundant cutting elements on the drill bit.

34. The drilling tool of claim 24, wherein the vector summation of each lateral force associated with the plurality of cutting elements exhibits a direction within ±70° of an imbalance force direction exhibited by the drill bit when drilling a homogeneous formation.

35. A method of designing a drilling tool, comprising:

selecting a cutting element profile;

selecting a subterranean formation to be drilled;

selecting an anticipated drilling path for drilling through the subterranean formation;

predicting a boundary surface between two regions of the subterranean formation;

wherein the two regions exhibit at least one different drilling characteristic;

placing a plurality of cutting elements along the cutting element profile;

positioning at least two redundant cutting elements of the plurality of cutting elements at an anticipated location of first contact of the drilling tool with the predicted boundary surface; and orienting the at least two redundant cutting elements at a backrake angle having a magnitude greater than a magnitude of a backrake angle of at least each cutting element of the plurality of cutting elements immediately adjacent the at least two redundant cutting elements in the cutting element profile.

36. The method of designing a drilling tool of claim 35, wherein placing the plurality of cutting elements comprises placing two or more redundant cutting elements at the anticipated location of first contact of the drilling tool with the predicted boundary surface.

37. The method of designing a drilling tool of claim 36, wherein positioning the at least two redundant cutting elements comprises placing the at least two redundant cutting elements at positions selected to generate lateral forces during drilling that substantially cancel with one another.

38. The method of designing a drilling tool of claim 36, further comprising:

placing the at least two redundant cutting elements so that the vector summation of each lateral force associated with the at least two redundant cutting elements is less than about 20% of a vector summation of the lateral force of each of the plurality of cutting elements.

39. The method of designing a drilling tool of claim 36, further comprising:

placing the at least two redundant cutting elements so that a vector summation of lateral forces associated with the at least two redundant cutting elements is oriented in a direction that is within ±70° of an imbalance force direction exhibited by the drilling tool when drilling a homogeneous formation.

40. The method of designing a drilling tool of claim 36, wherein positioning the at least two redundant cutting elements comprises placing the at least two redundant cutting elements at the anticipated location of first contact of the drilling tool with a plane oriented substantially perpendicular to a longitudinal axis of the drilling tool.

41. The method of designing a drilling tool of claim 40, wherein positioning the at least two redundant cutting elements comprises placing the at least two redundant cutting elements for substantially concurrently contacting the predicted boundary surface.

42. The method of designing a drilling tool of claim 35, wherein positioning the at least two redundant cutting elements comprises positioning the at least two redundant cutting elements for contacting the predicted boundary surface substantially concurrently.

43. The method of designing a drilling tool of claim 35, wherein positioning the at least two redundant cutting elements comprises orienting the at least two redundant cutting elements at a backrake angle having a magnitude greater than a magnitude of a backrake angle of all other cutting elements disposed on the drilling tool.

44. The method of designing a drilling tool of claim 35, wherein positioning the at least two redundant cutting elements comprises selecting the at least two redundant cutting elements to each comprise a superabrasive table having a thickness of between about 0.070 to 0.150 inch.

45. The method of designing a drilling tool of claim 44, wherein positioning the at least two redundant cutting elements comprises placing the at least two redundant cutting elements to each comprise at least one of a rake land and a chamfer.

46. The method of designing a drilling tool of claim 45, further comprising providing a rake land for each of the at least two redundant cutting elements, orienting a rake land angle of each of the at least two redundant cutting elements between 30° to 60° relative to a side wall of each of the at least two redundant cutting elements, respectively, and sizing each rake land of the at least two redundant cutting elements to have a length of at least about 0.050 inch.

47. The method of designing a drilling tool of claim 35, wherein positioning the at least two redundant cutting elements comprises placing the at least two redundant cutting elements for generating lateral forces during drilling that substantially cancel with one another.

48. The method of designing a drilling tool of claim 35, further comprising:

positioning the at least two redundant cutting elements so that the vector summation of each lateral force associated with the at least two redundant cutting elements is less than about 20% of a vector summation of the lateral force of each of the at least two redundant cutting elements.

49. The method of designing a drilling tool of claim 35, further comprising:

positioning the at least two redundant cutting elements so that a vector summation of lateral forces associated with the at least two redundant cutting elements is oriented in a direction that is within ±70° of an imbalance force direction exhibited by the drilling tool when drilling a homogeneous formation.

50. The method of designing a drilling tool of claim 35, wherein positioning the at least two redundant cutting elements comprises placing the at least two redundant cutting elements at the anticipated location of first contact of the drilling tool with a plane oriented substantially perpendicular to a longitudinal axis of the drilling tool.

51. The method of designing a drilling tool of claim 50, wherein positioning the at least two redundant cutting elements comprises placing the at least two redundant cutting elements for substantially concurrently contacting the predicted boundary surface.

52. A method of operating a drilling tool, comprising:

providing a drilling tool including a plurality of cutting elements on a face of the drilling tool, the plurality of cutting elements comprising at least two redundant cutting elements;

causing the at least two redundant cutting elements to be disposed at a backrake angle having a magnitude greater than a magnitude of a backrake angle of at least each cutting element of the plurality of cutting elements immediately adjacent the at least two redundant cutting elements in a cutting element profile of the plurality of cutting elements;

predicting a boundary surface defined between two abutting regions of a subterranean formation, the two abutting regions having at least one different drilling characteristic;

determining a drilling path, the drilling path oriented for positioning at least two redundant cutting elements of the plurality of cutting elements at an anticipated location of first contact of the drilling tool with a predicted boundary surface upon drilling generally therealong; and drilling into the predicted boundary surface generally along the orientation of the anticipated drilling path.

53. The method of operating a drilling tool of claim 52, wherein drilling into the predicted boundary surface comprises drilling into at least one of a casing shoe and cement.

54. The method of operating a drilling tool of claim 52, wherein drilling into the predicted boundary surface comprises drilling into different subterranean constituents.

55. The method of operating a drilling tool of claim 52, wherein drilling into the boundary surface between the two regions of the subterranean formation with the at least two redundant cutting elements changes a magnitude of lateral imbalance of the drilling tool by less than about 20%.

56. The method of operating a drilling tool of claim 52, wherein drilling into the boundary surface between the two regions of the subterranean formation with the at least two redundant cutting elements generates a net lateral force associated therewith that is oriented in a direction within ±70° of a direction of an overall imbalance force of the drilling tool when drilling a homogeneous formation.

57. The method of operating a drilling tool of claim 52, wherein drilling into the predicted boundary surface comprises substantially concurrently contacting the boundary surface with the at least two redundant cutting elements within the region of the profile.

58. The method of operating a drilling tool of claim 52, further comprising:

determining at least one of the orientation and position of the drilling tool in relation to the anticipated drilling path.

59. The method of operating a drilling tool of claim 58, further comprising:

aligning a drilling direction of the drilling tool generally along the orientation of the anticipated drilling path prior to drilling into the predicted boundary surface.

* * * * *

UNITED STATES PATENT AND TRADEMARK OFFICE

CERTIFICATE OF CORRECTION

PATENT NO. : 7,455,125 B2
APPLICATION NO. : 11/064108
DATED : November 25, 2008
INVENTOR(S) : L. Allen Sinor and Jack T. Oldham It is certified that error appears in the above-identified patent and that said Letters Patent is hereby corrected as shown below:

In the claims:

CLAIM 18, COLUMN 21, LINE 18, Change "toot" to --tool--

Signed and Sealed this
Twelfth Day of March, 2013

Teresa Stanek Rea
*Acting Director of the United States Patent and Trademark Office*